US009289356B2

(12) United States Patent
Farber et al.

(10) Patent No.: US 9,289,356 B2
(45) Date of Patent: Mar. 22, 2016

(54) STORAGE AND MIXING CONTAINER

(71) Applicants: Donna S. Farber, Toronto (CA); Mark C. Segal, Toronto (CA); Darryl Michael Farber, Don Mills (CA); Michael Basara, Bangkok (TH)

(72) Inventors: Donna S. Farber, Toronto (CA); Mark C. Segal, Toronto (CA); Darryl Michael Farber, Don Mills (CA); Michael Basara, Bangkok (TH)

(73) Assignee: BOUCHE BABY INC., Toronto, Ontario (CA)

( * ) Notice: Subject to any disclaimer, the term of this patent is extended or adjusted under 35 U.S.C. 154(b) by 547 days.

(21) Appl. No.: 13/837,948

(22) Filed: Mar. 15, 2013

(65) Prior Publication Data

US 2014/0260117 A1 Sep. 18, 2014

(51) Int. Cl.

| | |
|---|---|
| ***B65D 25/08*** | (2006.01) |
| ***A61J 9/00*** | (2006.01) |
| ***A61J 1/20*** | (2006.01) |
| ***A61J 11/00*** | (2006.01) |
| ***A61J 11/04*** | (2006.01) |

(52) U.S. Cl.

CPC ..... *A61J 9/00* (2013.01); *A61J 1/2093* (2013.01); *A61J 11/002* (2013.01); *A61J 11/008* (2013.01); *A61J 11/04* (2013.01); *A61J 1/2086* (2015.05); *A61J 9/0623* (2015.05)

(58) Field of Classification Search

CPC ..... A61J 11/04; A61J 9/001; A61J 9/00; A61J 1/2093; B65D 81/3211

USPC ..... 206/219–222; 215/6, 11.1, DIG. 8; 220/4.26, 4.24, 4.27; 366/130

See application file for complete search history.

(56) References Cited

U.S. PATENT DOCUMENTS

| | | | | |
|---|---|---|---|---|
| 2,226,146 | A | 12/1940 | Smith | |
| 2,326,414 | A * | 8/1943 | Thompson | B65D 7/00 206/503 |
| D248,373 | S | 7/1978 | Allen | |
| 4,779,722 | A * | 10/1988 | Hall | A61J 1/2093 206/219 |
| D335,428 | S | 5/1993 | Picozza et al. | |
| D347,359 | S | 5/1994 | Robbins, III | |

(Continued)

FOREIGN PATENT DOCUMENTS

| | | |
|---|---|---|
| CA | 2680510 A1 | 4/2011 |
| EP | 2491914 A2 | 8/2012 |
| WO | 2012060508 A1 | 5/2012 |

OTHER PUBLICATIONS

Notice of Allowance issued in U.S. Appl. No. 29/450,008 dated Jun. 16, 2014, 14 pp.

(Continued)

*Primary Examiner* — Chun Cheung
(74) *Attorney, Agent, or Firm* — Nixon & Vanderhye P.C.

(57) ABSTRACT

A beverage container is provided for separately storing a liquid apart form an additive until mixing. The beverage container has a vessel for retaining the liquid and a compartment for retaining the additive. The vessel has an open base at an end and a release valve is connected to another end. A base coupler is connected to the open base. The compartment has a connector at each of an open end and an opposing closed end of the compartment. Connecting the closed end and the open end of the compartment to the base coupler selectively separates and mixes the liquid and the additive, respectively. The beverage container has a closure for sealing the open end of the compartment when the liquid and additive are separated. A method for separating storing and mixing a liquid and additive is also provided. A kit assembly for a beverage container is also provided.

20 Claims, 23 Drawing Sheets

(56) References Cited

U.S. PATENT DOCUMENTS

| | | | | |
|---|---|---|---|---|
| 5,433,328 | A | 7/1995 | Baron et al. | |
| D364,089 | S | 11/1995 | Robbins, III | |
| D366,597 | S | 1/1996 | Smith et al. | |
| D381,259 | S | 7/1997 | Hayes | |
| 6,045,254 | A | 4/2000 | Inbar et al. | |
| 6,116,439 | A * | 9/2000 | Yaniv | A61J 9/00 215/10 |
| D474,651 | S | 5/2003 | Ward | |
| 6,575,208 | B2 | 6/2003 | Sharon et al. | |
| D579,722 | S | 11/2008 | Sakulsacha et al. | |
| 7,484,633 | B1 * | 2/2009 | Moher | A61J 11/04 206/219 |
| 7,798,346 | B2 * | 9/2010 | Nelson | B65D 81/3205 206/501 |
| D625,192 | S | 10/2010 | Kooser et al. | |
| 8,028,847 | B2 * | 10/2011 | Klaver | A61J 9/00 215/11.1 |
| D651,050 | S | 12/2011 | Goshi | |
| 8,146,758 | B1 * | 4/2012 | Peres | A61J 9/008 206/219 |
| D660,084 | S | 5/2012 | Gilbert | |
| 8,672,123 | B1 * | 3/2014 | Vallejo | A61J 9/00 206/219 |
| 2006/0254936 | A1 * | 11/2006 | Corbitt | B65D 81/3211 206/219 |
| 2007/0017890 | A1 * | 1/2007 | Al-Jadh | A61J 9/00 215/11.1 |
| 2010/0163439 | A1 | 7/2010 | Gutierrez Avendano | |

OTHER PUBLICATIONS

Audio transcrption and sceen shots for the Mixie Baby LLC poduct video at http://mixiebaby.com/mix, published Jul. 24, 2012, 8 pp.

Print-outs from the Mixie Baby LLC website at http://mixiebaby.com, as accessed Mar. 5, 2013.

Audio transcription and screen shots for the Mixie Baby LLC product video at http://mixiebaby.com/mix, published Jul. 24, 2012.

* cited by examiner

STORAGE AND MIXING CONTAINER

FIELD

The described embodiments relate to a beverage container, kit assembly and method for separately storing a liquid apart from an additive until mixing.

INTRODUCTION

There are many beverages that require a user to mix a liquid and an additive together prior to consumption. As an example, many caregivers mix powered baby formula together with water or milk, to provide a formula mixture to a baby or an infant. It is generally recommended that a mixed baby formula be consumed by a baby or infant shortly after the mixing. If the mixture is left too long (for example, more than an hour for some formulas), the mixture may develop undesirable taste, texture or mouth feel, or become harmful to the baby or infant. Mixtures that are consumed too long after mixing may develop harmful bacteria, for example, and may be detrimental to a baby or infant's health.

In some cases, a caregiver may mix a liquid and an additive at home. This becomes problematic if the caregiver and child are mobile (travel to the park, go shopping, etc.) and the child requires feeding long after leaving home, but before returning back to the house. In these cases, some caregivers store water and the baby formula, for example, separate from one another in separate containers when he/she leaves the home. The water and baby formula may then be combined at a remote location, just prior to feeding. Caregivers are often required to travel with many baby products including, for example, baby wipes, diapers, spare clothing and a stroller, to name a few. Traveling with separate containers for the liquid and additive inconveniently adds to the number of items that a caregiver has to take with his/her baby or infant. In addition, it may be difficult to retrieve both the liquid and the additive container (within a bag full of baby products, for example) when it is the child's feeding time.

In other cases, it may be desirable to mix liquids and additives beyond water and baby formula. For example, many sports enthusiasts consume athletic supplements following a work-out. If a supplement is mixed with a liquid too early, the supplement may clump together within the liquid, making the mixed beverage difficult to consume at a later time. Some of these individuals pack separate containers for the supplement additive and the liquid (such as milk, juice or water, for example) in their gym or work bag. They then combine the supplement and the liquid just prior to consumption. These separate containers for the liquid and the additive often add inconvenient bulk to an individual's bag and may be difficult to locate when they are separated from one another within a full gym bag, for example.

As further examples of mixable additives and liquids, it may be desirable to separately store and subsequently mix coffee with milk, juice with vitamins and minerals or carbonated liquids with flavoring, to name a few.

Portable containers that have multiple compartments to separately store and mix liquid with additive are known in the art. See, for example, United States Patent Application No. 2010/0163439 to Henry Alfonson Gutierrez Avendano and U.S. Pat. No. 8,028,847 to Jerell Klaver and Elissa Klaver.

Some of the existing multiple compartment, portable containers are unduly complicated, and comprise several moving parts that may be prone to mechanical fatigue and inoperability. Some of the existing containers are difficult to clean after mixing. Some of the existing containers are prone to leaking and/or insufficient mixing between the liquid and the additive.

There exists a need for an improved beverage container that separately stores a liquid apart from an additive until mixing.

SUMMARY

The following summary is intended to introduce the reader to the more detailed discussion to follow. The summary is not intended to limit or define the claims.

According to one broad aspect of this disclosure, a beverage container is provided for separately storing a liquid apart from an additive until mixing. The beverage container comprises a vessel for retaining the liquid. The vessel has an open base at an end of the vessel. A release valve is connected to another end of the vessel. A base coupler is connected to the open base of the vessel. The beverage container comprises a compartment for retaining the additive. The compartment has an open end and an opposing closed. The compartment has a connector at each end of the compartment, each of the connectors sealingly connectable to the base coupler. Connecting the connector at the closed end of the compartment to the base coupler separates the liquid and the additive. Connecting the connecter at the open end of the compartment to the base coupler permits the liquid and the additive to mix in the vessel. The beverage container comprises a closure for sealing the open end of the compartment when the liquid and the additive are separated.

In some embodiments, the compartment has a tubular wall extending between the open end and the closed end of the compartment.

In some embodiments, a plane defined by the open end of the compartment is substantially parallel to a plane defined by the closed end of the compartment.

In some embodiments, the beverage container comprises a sieve removably connectable to the open end of the compartment.

In some embodiments, the base coupler is removably attached to the open base of the vessel.

In some embodiments, the vessel and the compartment are tubular. The base coupler may comprise a coupling ring surrounding a portion of the vessel and the compartment to couple the compartment to the vessel.

In some embodiments, the beverage container comprises exterior threading at the open base of the vessel matable with a first interior threading portion on the coupling ring. The connectors at the open end and the closed end of the compartment may comprise exterior threading matable with a second interior threading portion on the coupling ring.

In some embodiments, the closure is removably connectable to the connector at the open end of the compartment to removably seal the open end of the compartment.

In some embodiments, the closure comprises a closure ring having internal threading. The connector at the open end of the compartment may comprise external threading engageable with internal threading on the closure ring, to couple the closure ring to the open end of the compartment.

In some embodiments, the closure is removably connectable to the connector at the closed end of the compartment.

In some embodiments, the closure is removably connectable to the open base of the vessel to removably seal the open base of the vessel.

In some embodiments, the base coupler comprises a coupling ring that is removably engageable with the open base of the vessel and the compartment to removably couple the compartment to the vessel. In some embodiments, the closure comprises a closure ring that is removably engageable with the open base of the vessel to removably seal the open base of the vessel when the coupling ring is disengaged from the open base of the vessel.

In some embodiments, the release valve is removably attached with a mouth of the vessel. When the release valve is engaged with the mouth, the release valve fluidly closes the mouth of the vessel. When the release valve is disengaged from the mouth, the mouth is open to receive the liquid therethrough.

In some embodiments, the beverage container comprises a valve ring removably connectable with the vessel to removably attach the release valve to the vessel.

In some embodiments, the beverage container comprises a cap removably engageable with the vessel to cover the release valve. The cap may have a first end that engages the vessel and a second end opposing the first end. The second end may have a substantially planar surface.

In some embodiments, the beverage container comprises another compartment for retaining an ancillary additive. The other compartment may have an open end and an opposing closed end. The other compartment may have a connector at the open end of the other compartment, the connector at the open end of the other compartment sealingly connectable with the closure. When the closure seals the open end of the compartment, connecting the connector at the open end of the other compartment to the closure separates the additive in the compartment from the ancillary additive in the other compartment.

According to another broad aspect of this disclosure, a kit assembly is provided for separately storing a liquid apart from an additive until mixing. The kit assembly comprises a vessel for retaining the liquid. The vessel has a mouth at one end and an open base at the other end. A release valve is removably engageable with the mouth of the vessel. A closure is removably connectable to the open base of the vessel to seal the open base.

The kit assembly optionally comprises a base coupler removably connectable to the open base of the vessel. The kit assembly optionally comprises a compartment for retaining the additive. The compartment has an open end and an opposing closed end. The compartment has a connector at each end of the compartment, each of the connectors sealingly connectable to the base coupler. Connecting the connector at the closed end of the compartment to the base connector separates the liquid and the additive. Connecting the connector at the open end of the compartment to the base connector permits the liquid and additive to mix in the vessel. The closure is connectable to the open end of the compartment to seal the open end of the compartment when the liquid and the additive are separated.

According to yet another broad aspect of this disclosure, a method is provided for separately storing a liquid apart from an additive until mixing. The method comprises introducing the liquid into an open base of a vessel to fill the vessel with the liquid, wherein a base coupler is attached to the open base of the vessel. The liquid is optionally introduced into the base either before or after the compartment is filled with additive, as described below. The method comprises placing an additive in an open end of a compartment having a closed end opposing the open end. The compartment has connectors at each end of the compartment, each of the connectors sealingly engageable to the base coupler. The method comprises sealing the open end of the compartment with a closure to retain the additive therein. The method comprises engaging the connector at the closed end of the compartment to the base coupler to maintain the liquid and the additive separate from one another. The method further comprises disengaging the closed end of the compartment from the base coupler. The method comprises moving the closure to unseal the open end of the compartment. The method further comprises engaging the connector at the open end of the compartment to the base coupler to permit the liquid and additive to mix in the vessel.

In some embodiments, the method comprises vertically orienting the vessel in an inverted position wherein the open base of the vessel faces upwardly prior to introducing the liquid into the open base of the vessel.

In some embodiments, the method comprises covering the open end of the compartment with a sieve (e.g. a rigid sieve or flexible mesh sieve) after placing the additive in the open end of the compartment. In some embodiments, engaging the connector at the open end of the compartment to the base coupler sift the additive passing through the sieve that travels from the compartment to the vessel.

DRAWINGS

Reference is made in the description of various embodiments to the accompanying drawings, in which.

DESCRIPTION OF VARIOUS EMBODIMENTS

Figure 1:
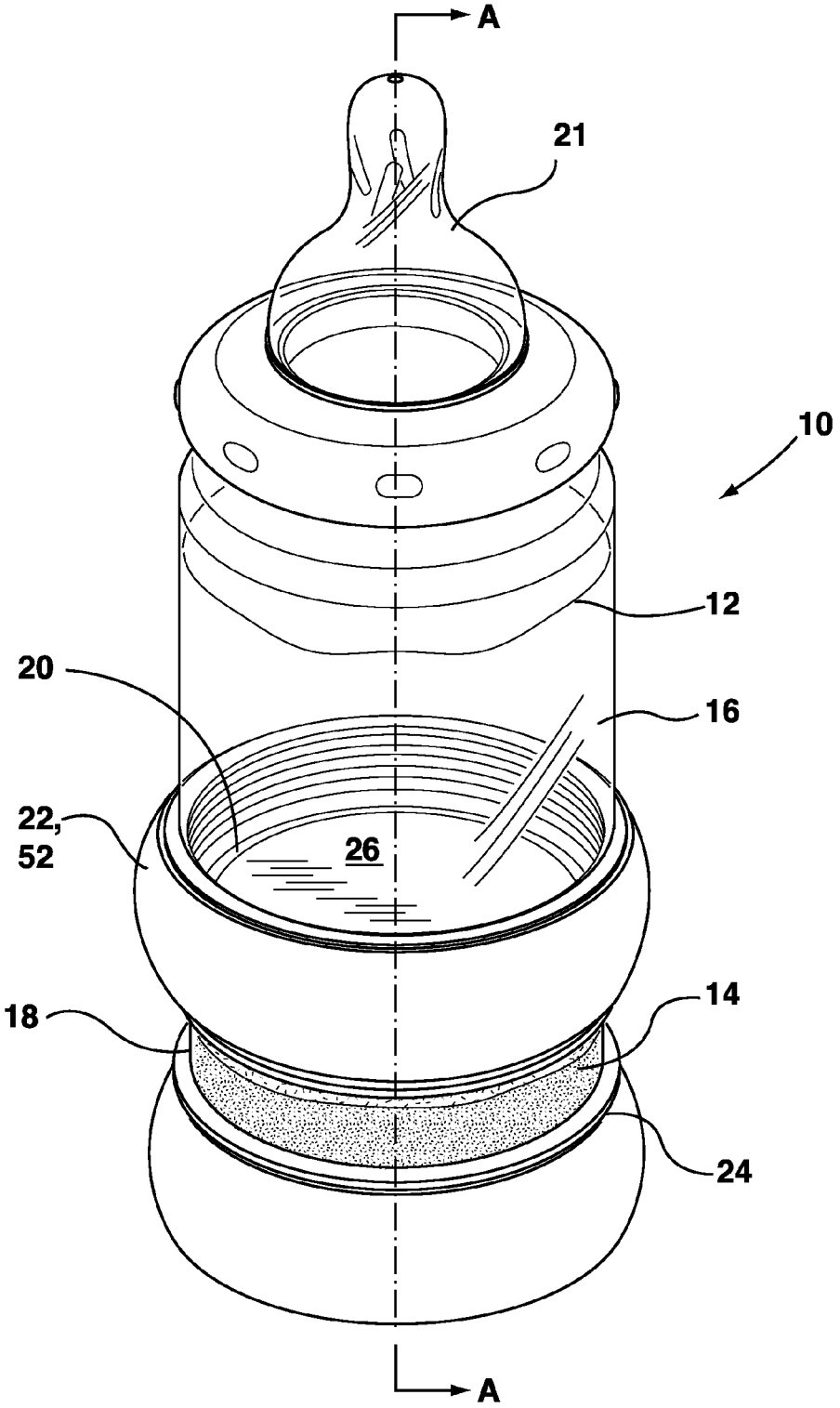
FIG. 1 is a perspective view of an exemplary assembled beverage container in accordance with an embodiment of the invention, wherein the compartment is in the closed position.

Reference is made to FIG. 1, which shows an example embodiment of beverage container 10. Beverage container 10 separately stores a liquid 12 apart from an additive 14 until mixing.

As exemplified in FIG. 1, beverage container 10 may be a baby bottle for storing, then subsequently mixing, a mixed beverage to be consumed by a baby or an infant. In some cases, liquid 12 is water and additive 14 is baby formula that mixes with the water to form a drinkable baby formula. The baby formula may be a dry powder or a liquid formula, for example. It is generally desirable to keep the water apart from baby formula until the baby or infant is ready to consume the mixed formula beverage. It is generally advisable for a baby or infant to consume a mixed formula beverage shortly after it is mixed, as it may spoil if it is not consumed shortly after mixing. Delaying too long between mixing and consumption may cause the baby or infant drinking the mixed formula to get sick from it.

By keeping the liquid (such as water, or in some cases, milk, for example) separate from baby formula in a portable container, a mobile caregiver can take beverage container 10 with him/her in a configuration in which liquid 12 is separated from additive 14. The caregiver can later manipulate beverage container 10 to mix the liquid and additive when the baby or infant is ready to consume the mixed beverage. In the embodiments that will be discussed, a beverage container is provided that may allow a caregiver to travel with a portable container that is operable between separation and mixing configurations, so as to keep the liquid and additive separate until a baby or infant, for example, is ready to consume the mixed liquid and additive.

Although the beverage container is described above as separating a liquid (such as water or milk, for example) from baby formula, beverage container 10 may separate and mix a variety of liquids and additives. Examples of liquids include, but are not limited to water, juice, milk, coffee, tea and carbonated beverages. Examples of additives include powders (particles) or liquids, including but not limited to, baby formula, creamer, milk or creamers (liquids or powders), minerals, vitamins and nutritional supplement formulas (eg. athletic supplements, protein powders, or weight loss powders). The beverage container may be used by any mammal of any age, including, for example, a human baby, infant, child, teenager or adult. The beverage container may also be used to provide a mixed beverage to an animal, such as a domestic dog or cat, for example. The additive may be in solid or liquid form. As non-limiting examples, the beverage container may be used to mix a milk or creamer additive to coffee, and to mix a protein powder additive to milk. For the example of mixing protein powder with milk, it may be advantageous to mix the liquid and additive just prior to consumption, to minimize the clumping and settlement of the protein powder in the milk. In some cases, liquid 12 comprises a mixture of different liquids. In some cases, additive 14 comprises a mixture of different additives.

In some cases, at least one of the liquid and additive may be cooled or heated within beverage container 10 prior to consumption. The beverage container optionally has insulated sides.

Referring to FIG. 1, exemplary beverage container 10 has a vessel 16 for retaining liquid 12 and a compartment 18 for retaining additive 14.

Liquid 12 can be fluidly sealed within vessel 16, to prevent liquid 12 from leaking out of vessel 16. Vessel 16 may be made of glass or plastic, for example. In some embodiments, vessel 16 is able to withstand heating (such as by a microwave) or cooling to adjust the temperature of liquid 12 therein. In some embodiments, vessel 16 is transparent, so that a user can see into vessel 16 and properly gauge the amount of liquid introduced into vessel 16.

Similarly, compartment 18 can be fluidly sealed to retain additive 14 therein (which may be in solid or liquid form).

In the embodiment shown in FIG. 1, vessel 16 has an open base 20 at an end of vessel 16. As exemplified, beverage container 10 has a release valve 21 connected to another end of vessel 16. When the components of beverage container 10 are assembled (as exemplified in FIG. 1), release valve 21 may provide an exit for liquid 12 (or a mixed beverage) stored in vessel 16, to deliver liquid 12 (or a mixed beverage) to the mouth of a user. In some cases, release valve 21 is a nipple that releases liquid 12 (or a mixed beverage) when engaged by a baby or infant's mouth. As exemplified in FIG. 1, beverage container 10 also has a base coupler 22 connected to open base 20 of vessel 16.

Figure 2:
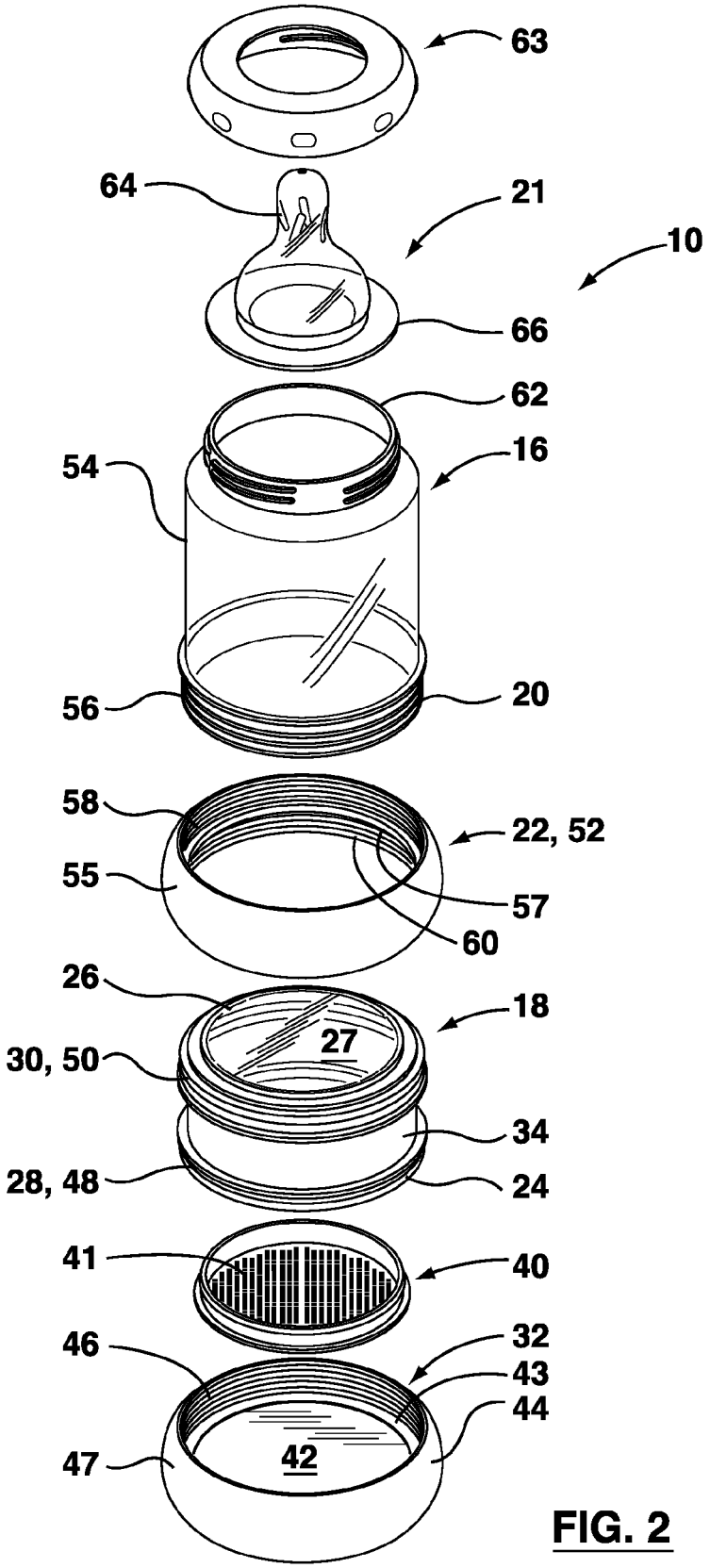
FIG. 2 is an exploded perspective view of the unassembled beverage container of FIG. 1.

FIG. 2 provides an exemplary unassembled view of beverage container 10 of FIG. 1, to more clearly show its constituent parts. As exemplified in FIG. 2, compartment 18 has an open end 24 and an opposing closed end 26. Optionally, opposing means that the opposing open end 24 and closed end 26 lie in different planes, but at least partially face one another. Open end 24 and opposing end 26 may be parallel or offset relative to one another.

As shown in FIG. 2, compartment 18 has a connector at each end of compartment 18 (see connectors 28 and 30). FIG. 2 shows connector 28 at open end 24, and connector 30 at closed end 26.

Continuing to refer to FIG. 2, each of connectors 28 and 30 are sealingly connectable to base coupler 22. Connectors 28 and 30 may each form a fluid-tight seal when engaged with base coupler 22.

FIG. 2 exemplifies the orientation of compartment 18 when connector 30 at closed end 26 of compartment 18 is connected to base coupler 22.

Figure 3:
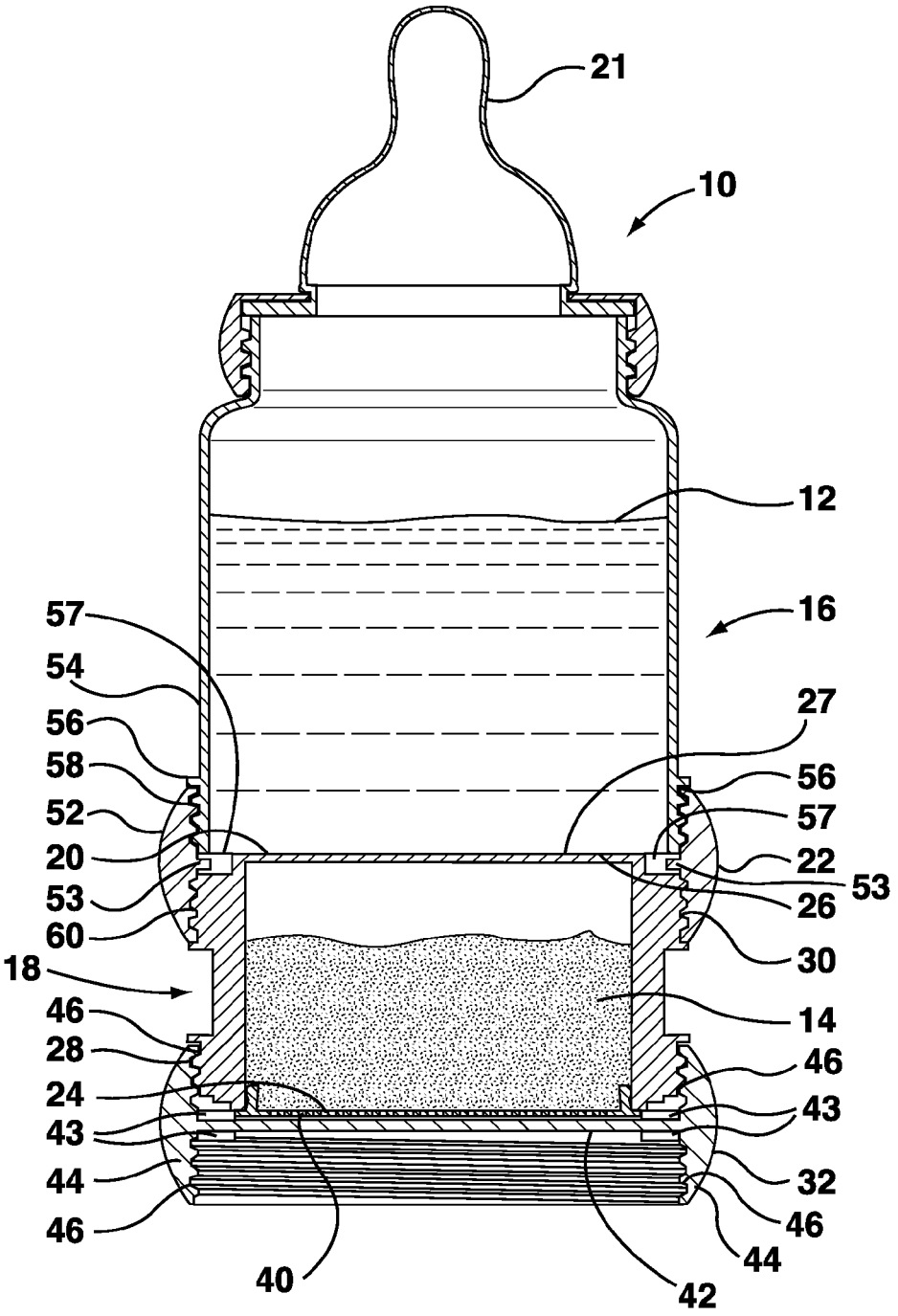
FIG. 3 is a cut-away sectional side view taken along line A-A in FIG. 1.

FIG. 3 provides a cut-away sectional side view of the configuration shown in FIG. 2. As exemplified in FIG. 3, connecting connector 30 at closed end 26 of compartment 18 to base coupler 22 separates liquid 12 and additive 14. As exemplified, closed end 26 comprises a solid end wall 27. When compartment 18 is oriented in a closed position relative to vessel 16 (as exemplified in FIGS. 2 and 3), closed end 26 of compartment 18 of blocks open end 20 of vessel 16, to prevent liquid 12 from passing into compartment 18 and prevent additive 14 from passing into vessel 16. When compartment 18 is in this closed position, a user may transport beverage container 10 with liquid 12 separated from additive 14. As exemplified in FIG. 3, solid wall 27 may fluidly seal with open base 20 to prevent the passage of liquid 12 and additive 14 between vessel 16 and compartment 18. In some embodiments, vessel 16 has a tubular wall 54 that contacts solid wall 27 to fluidly seal vessel 16 from compartment 18.

As exemplified in FIG. 3, when compartment 18 is in the closed position, open end 24 of compartment 18 may be spaced from open base 20 of vessel 16. Beverage container 10 has a closure 32 for sealing open end 24 of compartment 18 when liquid 12 and additive 14 are separated. In this manner, when compartment 18 is in the closed position (as shown in FIG. 3), closure 32 prevents additive 14 from escaping from open end 24 of compartment 18. Closure 32 may fluidly seal open end 24 of compartment 18.

Figure 4:
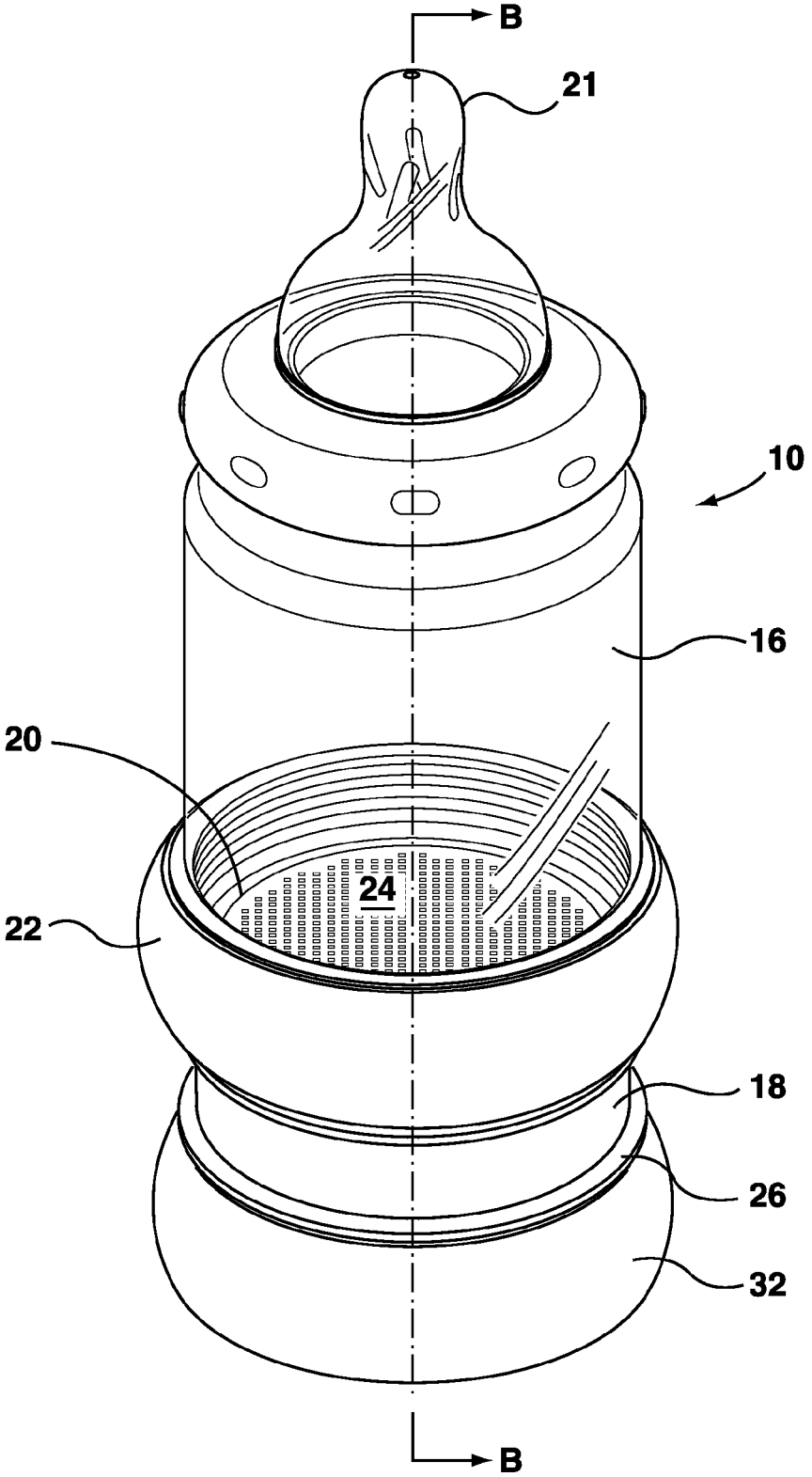
FIG. 4 is a perspective view of the assembled beverage container of FIG. 1, wherein the compartment is in the open position.

FIG. 4 provides an exemplary perspective view of compartment 18 reoriented to an open position relative to vessel 16. The open position of compartment 18 exemplified in FIG. 4 is different than the closed position of compartment 18 exemplified in FIGS. 1 to 3.

Figure 5:
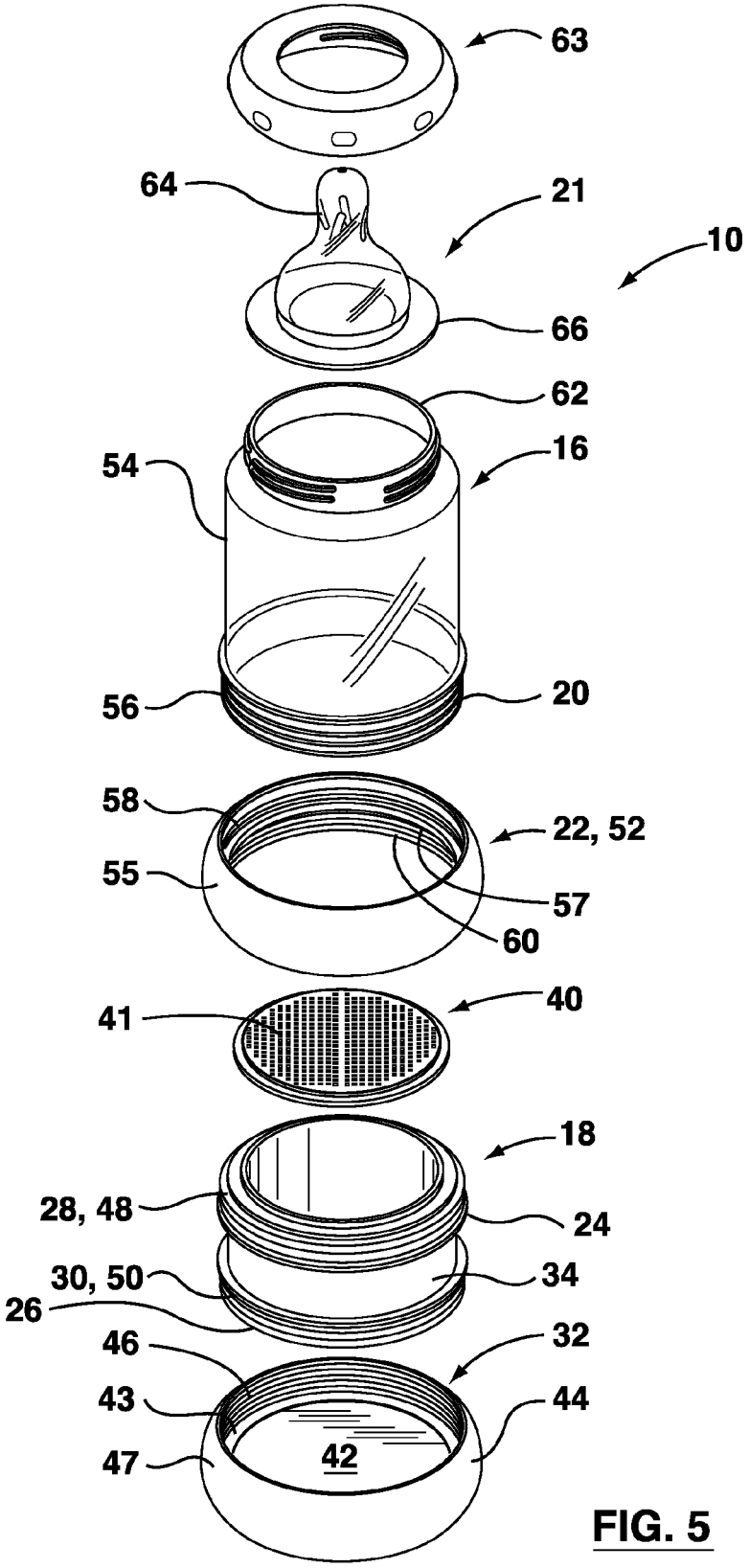
FIG. 5 is an exploded perspective view of the unassembled beverage container of FIG. 4.

FIG. 5 provides an unassembled view of the beverage container 10 illustrated in FIG. 4.

Figure 6:
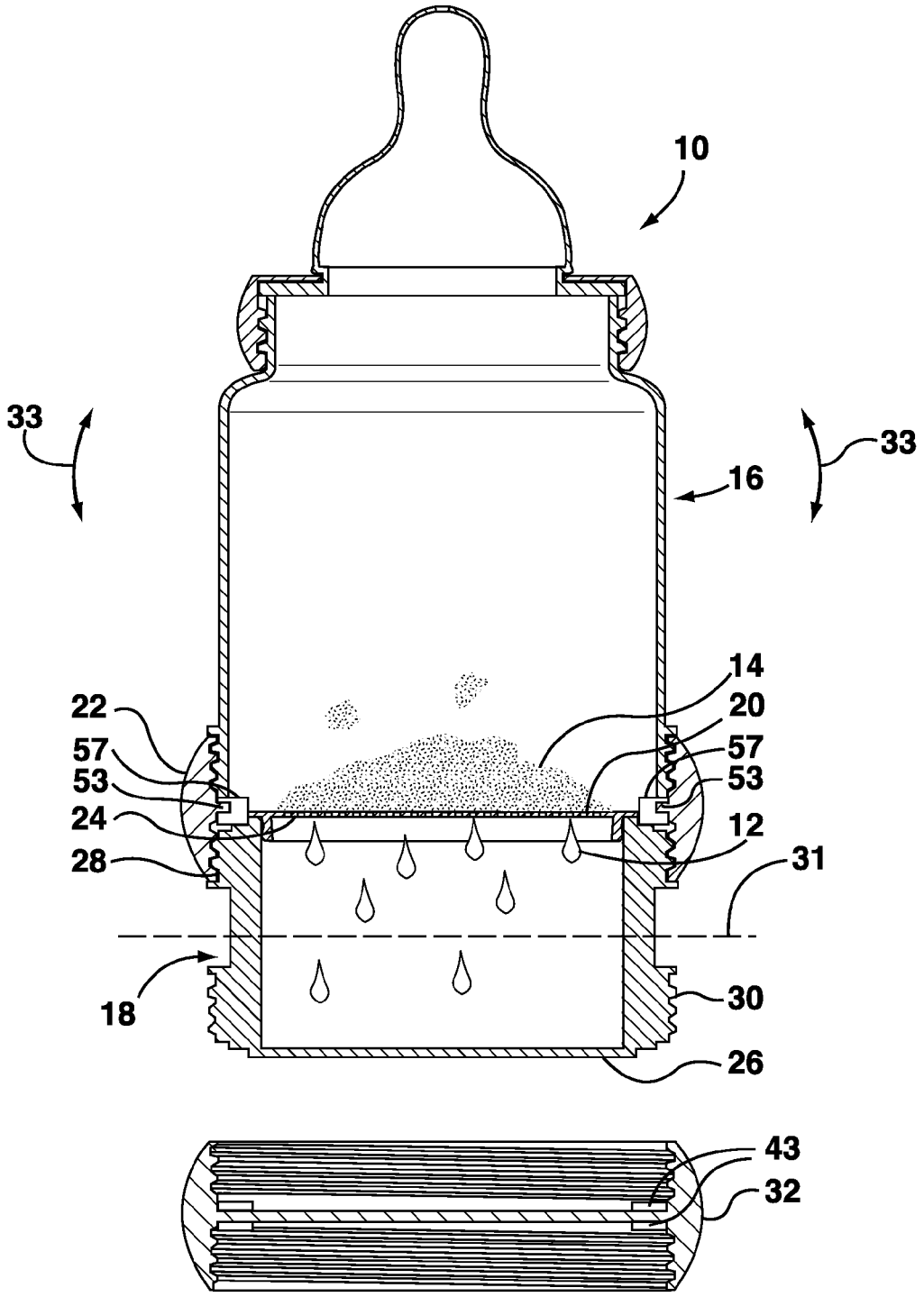
FIG. 6 is a cut-away sectional side view taken along line B-B in FIG. 4.

FIG. 6 provides a cut-away sectional side view of the configuration illustrated in FIGS. 4 and 5.

The closed position of compartment 18 is exemplified in FIG. 2 and, by contrast, the open position of compartment 18 is exemplified in FIG. 5. In some cases, compartment 18 may be rotated between the closed position (FIG. 2) and the open position (FIG. 5). In some more specific cases, compartment 18 may be rotated about a rotation axis 31 that is substantially parallel to open base 20 of vessel 16 (exemplified in FIG. 6). As exemplified, compartment 18 may be rotated approximately 180 degrees from the closed position (FIG. 2) to the open position (FIG. 5).

FIGS. 4 to 6 exemplify compartment 18 in the closed position. As exemplified most clearly in FIG. 6, connector 28 at open end 24 of compartment 18 is connected to base coupler 22. As exemplified in FIG. 6, connecting connector 28 at open end 24 of compartment 18 to base coupler 22 permits liquid 12 and additive 14 to mix in vessel 16. In this manner, a fluidly open passage may be provided through open end 24, between vessel 16 and compartment 18.

To facilitate the mixing of liquid 12 and additive 14, beverage container 10 may be shaken or agitated. Agitation arrows 33 indicate exemplary agitation movement. In some embodiments, the user may translate container 10 in a horizontal manner, a vertical manner, or a combination thereof, to mix the liquid and additive. The user may also rotate beverage container 10 to mix its contents, or may rotate beverage container 10 in combination with translational movement. In some embodiments, beverage container 10 may be inverted from its orientation shown in FIG. 6, to facilitate the movement of additive 14 through open end 24 of compartment 18 and into vessel 16.

Continuing to refer to FIG. 6, when compartment 18 is in the open position, closed end 26 of compartment 18 may be spaced from open base 20 of vessel 16. Closure 32 may be removably connectable to connector 30 at closed end 26 of compartment 18. In some cases, closure 32 may be attached to connector 30 to conveniently keep closure 30 attached to the rest of beverage container 10 during mixing and subsequent consumption. This closure-to-beverage container connection may conveniently avoid having to separately store, and possibly loose, a detached closure 32. In some cases, closure 32 may remain disconnected from connector 30 during the mixing of liquid 12 and additive 14. It will be appreciated that closure 32 is not necessary required to maintain the mixed beverage in compartment 18 and vessel 16, because closed end 26 may prevent the movement of a mixed beverage, liquid 12 and/or additive 14 past closed end 26. Attaching closure 32 to connector 30 at closed end 26 of compartment 18 may provide an additional layer of impact protection, in case the user drops the beverage container, for example.

Figure 7:
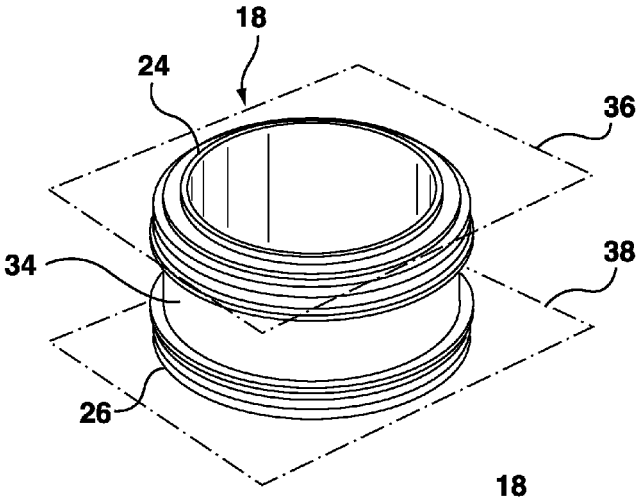
FIG. 7 is perspective view of an exemplary compartment.

FIG. 7 provides a perspective view of an exemplary compartment 18. Compartment 18 may have a tubular wall 34 extending between open end 24 and closed end 26.

Figure 8:
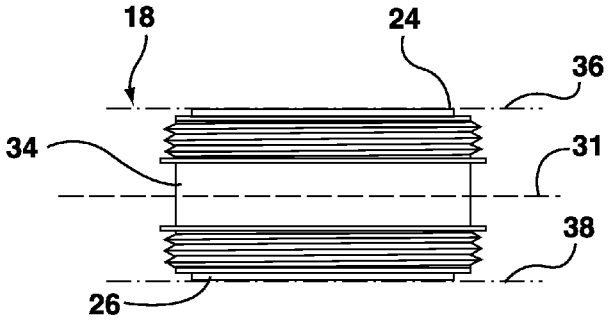
FIG. 8 is a side view of the compartment of FIG. 7.

FIG. 8 provides a side view of compartment 18 of FIG. 7.

As exemplified in FIGS. 7 and 8, a plane 36 is defined by open end 24 of compartment 18. As exemplified, a plane 38 is defined by closed end 26 of compartment 18. As shown in FIGS. 7 and 8, open end 24 and closed end 26 lie in different planes. As shown, plane 36 may be spaced from and substantially parallel to plane 38. As shown in FIG. 8, parallel ends 24 and 26 may be parallel to rotation axis 31, to facilitate the inversion of compartment 18 between the closed position (see FIG. 3) and the open position (see FIG. 6). In alternative embodiments, plane 36 may be offset (i.e. at an angle to) plane 38.

Figure 9:
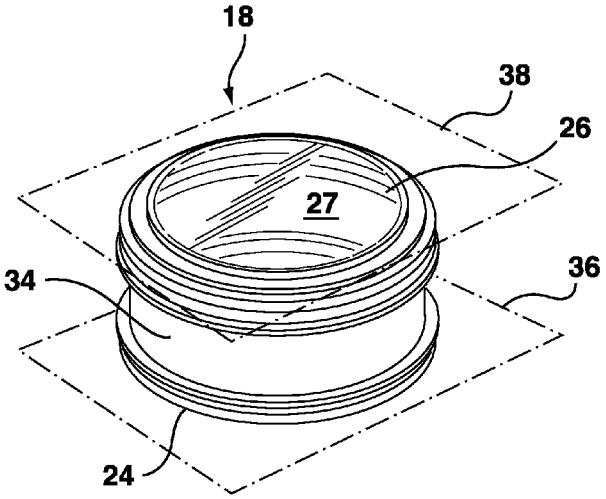
FIG. 9 is a perspective view of the compartment of FIGS. 7 and 8, inverted from its position shown in FIGS. 7 and 8.

FIG. 9 provides a perspective view of compartment 18, rotated by 180 degrees about rotation axis 31 relative to its position in FIG. 7, to more clearly show closed end 26.

Referring to FIG. 9, compartment 18 may be made of plastic or glass, for example. In some embodiments, tubular wall 34 and closed end 26 are transparent to allow the user to view additive stored therein. More specifically, compartment 18 may be entirely transparent. The transparent surfaces may allow a user to easily visualize the level of the additive deposited into compartment 18, to facilitate the placement of a proper amount of additive into compartment 18. The proper amount of additive may vary with the age of the individual that will consume the mixed beverage and the type of additive, for example.

Referring back to FIG. 2, in some embodiments, beverage container 10 may have a sieve 40 having spaced perforations 41 therein. Sieve 40 may be made of plastic, for example.

Figure 10:
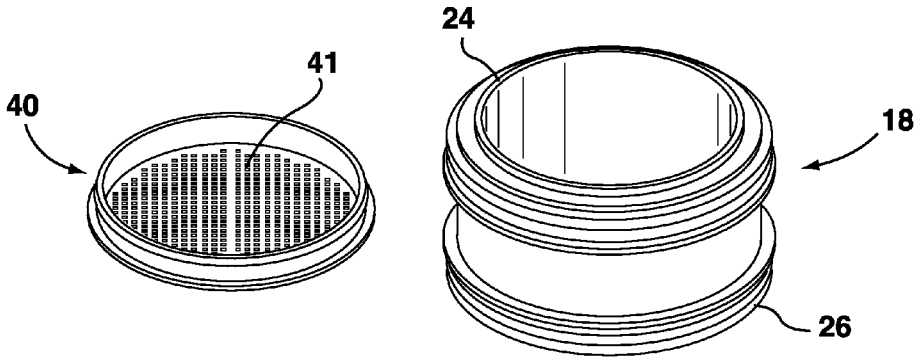
FIG. 10 is a perspective view of the compartment of FIG. 7 and an exemplary sieve.
Figure 11:
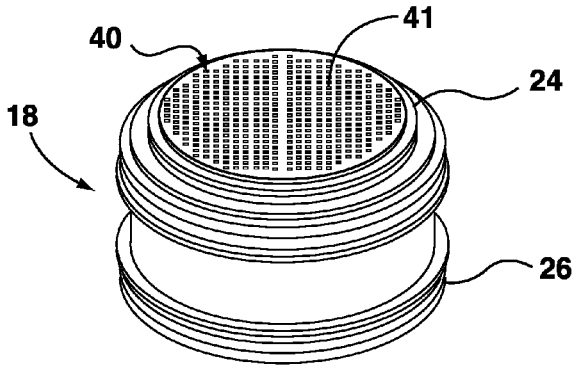
FIG. 11 is a perspective view of the compartment and sieve of FIG. 10 combined together.

FIG. 10 shows sieve 40 and compartment 10 disengaged from one another. FIG. 11 shows sieve 40 engaged with compartment 10, connected to open end 24 of compartment 18. In some embodiments, sieve 40 is removably connectable to open end 24 of compartment 18. Sieve 40 may be friction-fit into open end 24 of compartment 18, for example.

In the embodiment illustrated in FIG. 2, beverage container 10 has closure 32. Closure 32 may be removably connectable to connector 28 at open end 24 of compartment 18 to removably seal open end 24 of the compartment. Closure 32 may be made of plastic, for example.

Figure 12:
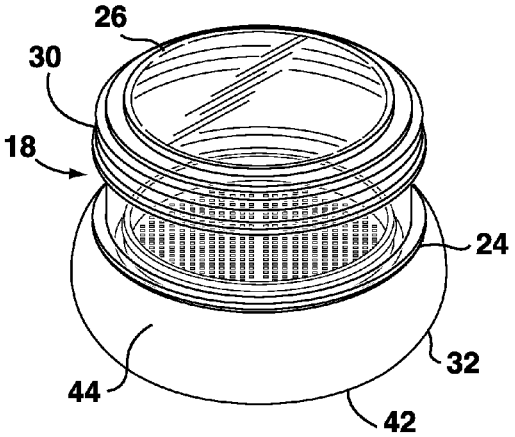
FIG. 12 is a perspective view of the combined compartment and sieve of FIG. 11 connected to an exemplary closure at the open end of the compartment.

FIG. 12 exemplifies closure 32 connected to open end 24 of compartment 18. When compartment 18 is in the closed position (see FIG. 3), solid wall 42 of closure 32 may seal open end 24, to retain additive 14 in compartment 18 (as shown in FIG. 12).

Figure 13:
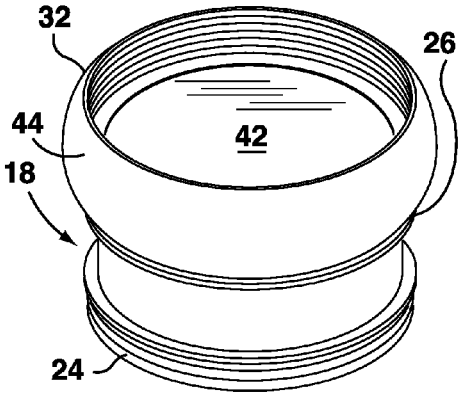
FIG. 13 is a perspective view of the combined compartment and sieve of FIG. 11 connected to an exemplary closure at the closed end of the compartment.

As exemplified in FIG. 13, closure 32 may be removably connectable to connector 30 (see connector 30 in FIG. 12) at closed end 26 of compartment 18.

FIG. 13 exemplifies closure 32 connected to closed end 26 of compartment 18, and more clearly shows solid wall 42 of closure 32. As previously discussed above, it may be advantageous in some cases to connect closure 32 to closed end 26 when liquid 12 is mixed with additive 14 (as shown in FIG. 6) to prevent closure 32 from being misplaced or to provide an additional layer of impact protection.

Referring back to FIG. 2, closure 32 may comprise a closure ring 44. Closure ring 44 may comprise a circular wall that extends substantially orthogonally from solid wall 42. Closure ring 44 may have a convex surface 47 that faces outwardly relative to compartment 18.

Referring to FIG. 3, closure ring 44 may have a closure seal 43 adjacent at least one face of solid wall 42. As shown in FIG. 2, closure seal 43 may be a circular seal located along a circular perimeter of solid wall 42. In some cases, as shown in FIG. 3, closure seals 43 may be located adjacent to two different faces of solid wall 42. In this manner, either end of closure 42 may be attached to open end 24 of the closure to fluidly seal open end 24. In some cases, closure 32 may be attached upright or inverted relative to open end 24, to fluidly seal open end 24.

Referring now to FIG. 2, closure ring 44 may have internal threading 46. Connector 28 at open end 24 of compartment 18 may comprise external threading 48 engageable with internal threading 46 on closure ring 44, to couple the closure ring 44 to open end 24 of compartment 18 (as shown in FIG. 12).

Returning to FIG. 3, solid wall 42 of closure 32 may bisect the closure ring 44, thereby separating internal threading 46 into two separate threading portions. In this manner, either end of closure 32 may be attached to open end 24 of compartment 18 to fluidly seal open end 24. In some cases, closure 32 may attached upright or inverted relative to open end 24, to fluidly seal open end 24.

In alternative embodiments, the closure and open end may comprise corresponding grooves and protrusions that mate with one another to connect the closure to the open end. The closure may be snap-fit onto the open end. In alternative embodiments, the closure may comprise an expandable material, such as rubber, for example, that stretches onto the open end to fittingly engage the compartment.

Referring now to FIG. 5, connector 30 at closed end 26 of compartment 18 may comprise external threading 50 engageable with internal threading 46 on closure ring 44, to couple the closure ring 44 to closed end 26 of compartment 18 (as shown in FIG. 13). In alternative embodiments, the closure and the closed end may comprise corresponding grooves and protrusions that mate with one another to connect the closure to the closed end. The closure may be snap-fit onto the closed end. In alternative embodiments, the closure may comprise an expandable material, such as rubber, for example, that stretches onto the closed end to fittingly engage the compartment.

Referring back to FIG. 2, base coupler 22 may be removably attached to open base 20 of vessel 16. Base coupler 22 made be made of plastic, for example. In some embodiments, vessel 16 and compartment 18 are tubular, as defined by tubular walls 54 and 34, respectively. As exemplified in FIG. 1, base coupler 22 may comprise a coupling ring 52 surrounding a portion of vessel 16 and compartment 18 to couple the compartment to the vessel.

As exemplified in FIG. 2, coupling ring 52 may comprise a hollow circular wall. Coupling ring 52 may have a convex surface 55 that faces outwardly relative to vessel 16.

Referring now to FIG. 3 coupling ring 52 may have a coupling flange 53 that extends inwardly from coupling ring 52. Coupling flange 53 may extend continuously around an interior perimeter of coupling ring 52. In other embodiments, coupling flange 53 may comprise a plurality of flanges spaced apart from one another along an interior perimeter of coupling ring 52.

Continuing to refer to FIG. 3, coupling ring 52 may have a coupling seal 57 disposed on at least one face of coupling flange 53. As shown in FIG. 3, coupling seal 57 may surround coupling flange 53. As shown in FIG. 2, seal 57 may be a circular seal located along an interior perimeter of coupling ring 52. As exemplified in FIG. 3, coupling seal 57 may facilitate a fluidly sealed connection between base 20 of vessel 16 and closed end 26 of compartment 18.

Referring now to FIGS. 2 and 3, vessel 16 may have exterior threading 56 at open base 20. The exterior threading may be matable with a first interior threading portion 58 on coupling ring 52. Connector 30 at closed end 26 of compartment 18 and connector 28 at open end 24 may comprise exterior threading 50 and 48, respectively, matable with a second interior threading portion 60 on coupling ring 52. In some cases, flange 53 (optionally having seal 57 thereon) separates first interior threading portion 58 from second interior threading portion 60 of coupling ring 52. In some embodiments, flange 53 bisects coupling ring 52. In some embodiments, seal 57 mounted to flange 53 separates first interior threading portion 58 from the second interior threading portion 60 of coupling ring 52.

In some cases, coupling ring 52 may be connected to open base 20 of vessel 16 by first interior threading portion 58 or second interior threading portion 60.

In some cases, base coupler 22 may have a similar shape and configuration to closure 32. In these cases, when the base coupler 22 and the closure are made of plastic, for example, the same injection mold may be used to manufacture base coupler 22 and closure 32. This may be advantageous to reduce manufacturing costs. In some cases, base coupler 22 and closure 32 may be different colors, or have different indicia marked thereon, to allow the user to more easily differentiate between base coupler 22 and closure 32.

In some alternative embodiments, the base coupler and the open base may comprise corresponding grooves and protrusions that mate with one another to connect the base coupler to the open base. Similarly, the base coupler and the compartment may have corresponding grooves and protrusions that connect the base coupler to the compartment.

The base coupler may be snap-fit onto the open base, and the base coupler may be snap-fit together with the compartment.

In some alternative embodiments, the base coupler may comprise an expandable material, such as rubber, for example, that stretches onto the open base to fittingly engage the vessel. Similarly, the base coupler may comprise an expandable material, such as rubber, for example, that stretches onto the compartment, to fittingly engage the compartment.

In some embodiments, base coupler 22 may be integrally formed with vessel 16. As a non-limiting example, base coupler 22 may comprise threading on wall 54 of vessel 16 that is directly connectable to corresponding threading on compartment 18. In alternative embodiments, base coupler 22 may be fixedly attached to vessel 16.

In the embodiment shown in FIG. 2, beverage container 10 has a release valve 21. Release valve 21 may be used to provide a mixed beverage in container beverage 10 (optionally, after the liquid has mixed with the additive) to a baby or infant, for example.

Release valve 21 may be removably attached with mouth 62 of vessel 16. Container 10 may comprise a valve ring 63 removably connectable with vessel 16 to removably couple release valve 21 to vessel 16. Valve ring 63 may have threads thereon that mate with corresponding threads on mouth 62. Release valve 21 may be operable to selectively prevent and permit fluid from flowing through mouth 62 of vessel 16.

In some embodiments, release valve 21 is removably engageable with mouth 62 and when release valve 21 is engaged with mouth 62, release valve 21 may fluidly close the mouth of the vessel. In this manner, liquid 12 in vessel 16 may be substantially prevented from exiting to the external atmosphere from vessel 16. When release valve 21 is disengaged from mouth 62, the mouth may open to transfer mixed beverage or liquid therethrough and out of vessel 16. In some embodiments, release valve 21 may be a lid that is removably engageable with mouth 62.

Alternatively, release valve 21 may be fixedly connected to vessel 16. More specifically, release valve 21 may be integrally formed with vessel 16.

In some embodiments, release valve 21 may comprise a one-way valve that permits fluid flow out of vessel 16, but not into vessel 16. Release valve 21 may have apertures 64 therein for selectively permitting a mixed beverage in vessel 16 to flow therethrough and out of the vessel 16. Release valve 21 may be a rubber nipple, which permits the flow of fluid through apertures 64 when a baby's mouth, for example, engages the nipple, but otherwise prevents fluid flow through apertures 64. In an alternative embodiment, release valve 21 may comprise a "sippy-cup" attachment that uses surface tension across an opening fluidly connected to mouth 62 to prevent liquid from existing vessel 16 through the opening. The release valve is optionally a pouring spout with opened and closed positions.

Release valve 21 may have a peripheral seal 66 for sealably engaging mouth 62 of vessel 16, to facilitate the prevention of leakage through mouth 62.

Figure 14:
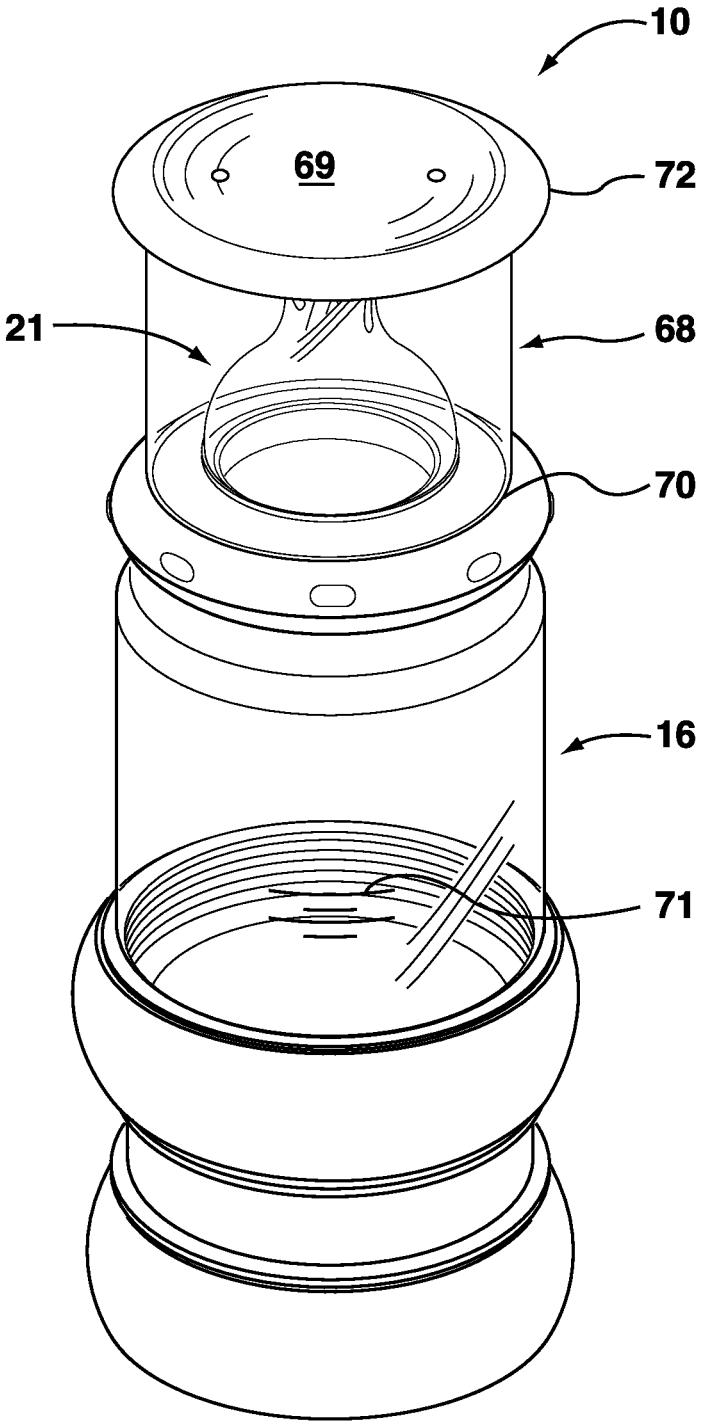
FIG. 14 is a perspective view of the beverage container of FIG. 1 connected to an exemplary cap.

Referring now to FIG. 14, beverage container 10 may have cap 68. Cap 68 may be removably engageable with vessel 16 to cover release valve 21. Cap 68 may have a first end 70 that engages vessel 16 and a second end 72 opposing first end 70. The second end may have a substantially planar surface 69.

Figure 15:
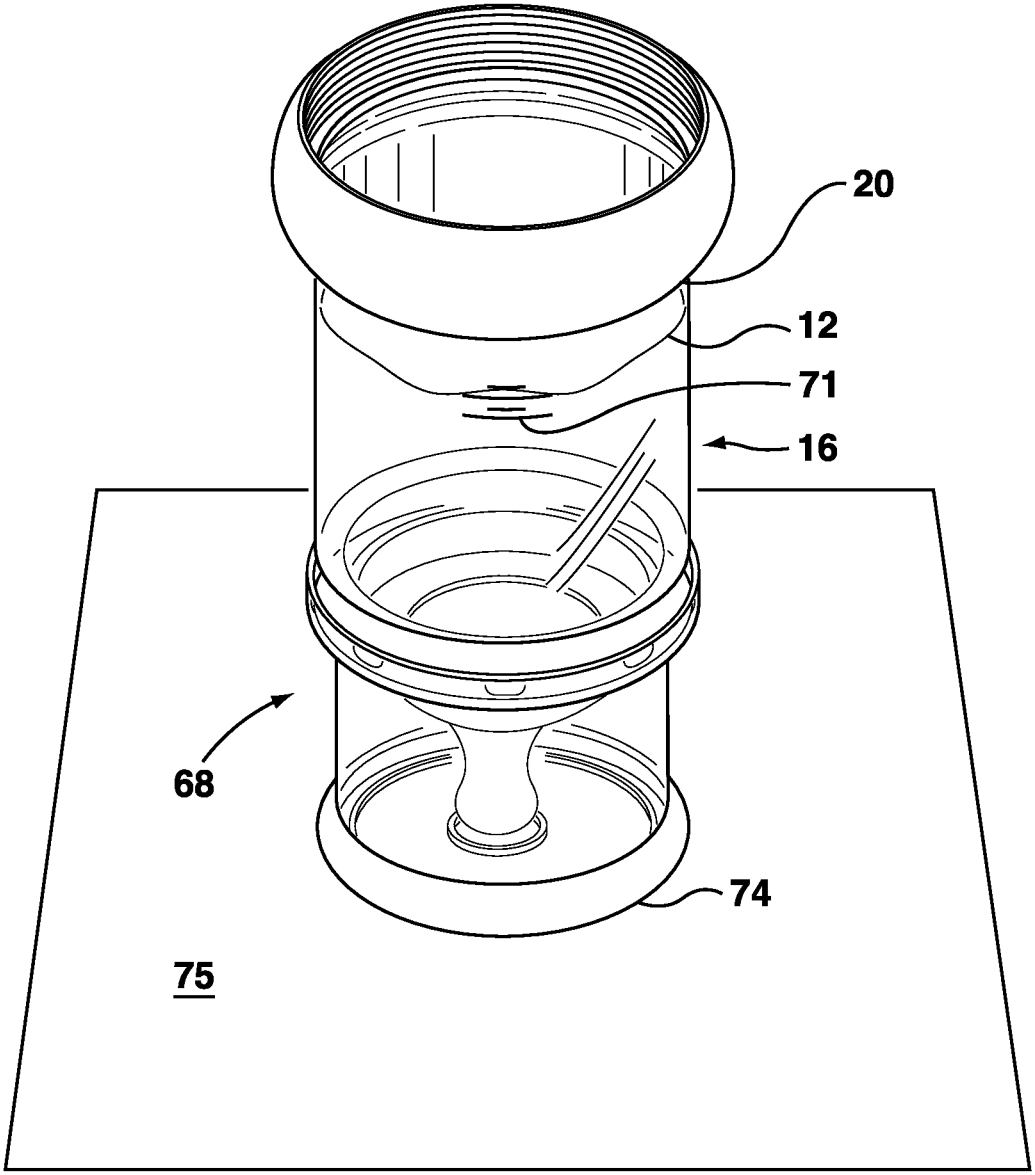
FIG. 15 is a perspective view of the beverage container of FIG. 14, wherein the beverage container is inverted from its position shown in FIG. 14 and the compartment is removed.

FIG. 15 shows a portion of container 10 inverted, to allow vessel 16 to receive liquid 12 therein through open base 20. In some embodiments (as shown in FIG. 14, for example), planar surface 69 is not completely planar, but is substantially planar in the sense that is can stably support inverted vessel 16 to stand upright on a substantially flat surface (as shown in FIG. 15). Cap 68 may allow a user to fill inverted vessel 16 (as shown in FIG. 15) with liquid 12 by standing inverted vessel 16 on flat surface 75, such as a kitchen counter, for example. In this manner, the user may not need to hold vessel 16 with one hand while pouring liquid 12 with his/her other hand. In this manner, the user may be able to fill vessel 16 using just one hand.

In some embodiments, as exemplified in FIG. 14, beverage container 10 may have a fill line 71. In some cases, the beverage container may have a plurality of fill lines, corresponding to different volumes of liquid filled into vessel 16 (such as 50 mL, 90 mL, 110 mL and 150 mL of liquid, for example). In some cases, a number (indicating fill volume, for example) is placed adjacent to a corresponding fill line. In some cases, numbers are provided that correspond to fill volumes for liquid introduced into vessel 16 liquid through mouth 62 of the vessel (mouth 62 is shown in FIG. 2).

In some cases, the numbers correspond to fill volumes for liquid introduced into vessel 16 though open base 20 of the vessel. The numbers used to facilitate filling through open base 20 may be printed on vessel 16 so that when vessel 16 is upright (as shown in FIG. 14), the numbers are inverted, and when vessel 16 is inverted (as shown in FIG. 15), the numbers are upright. These numbers may make it easier for the user to place a proper amount of liquid 12 in vessel 16 through open base 20 when open base 20 faces upwardly (as shown in FIG. 15).

In some cases, different sets of fill lines may be provided for filling vessel 16 through the mouth (see mouth 62 in FIG. 2) and filling through open base 20.

Figure 16:
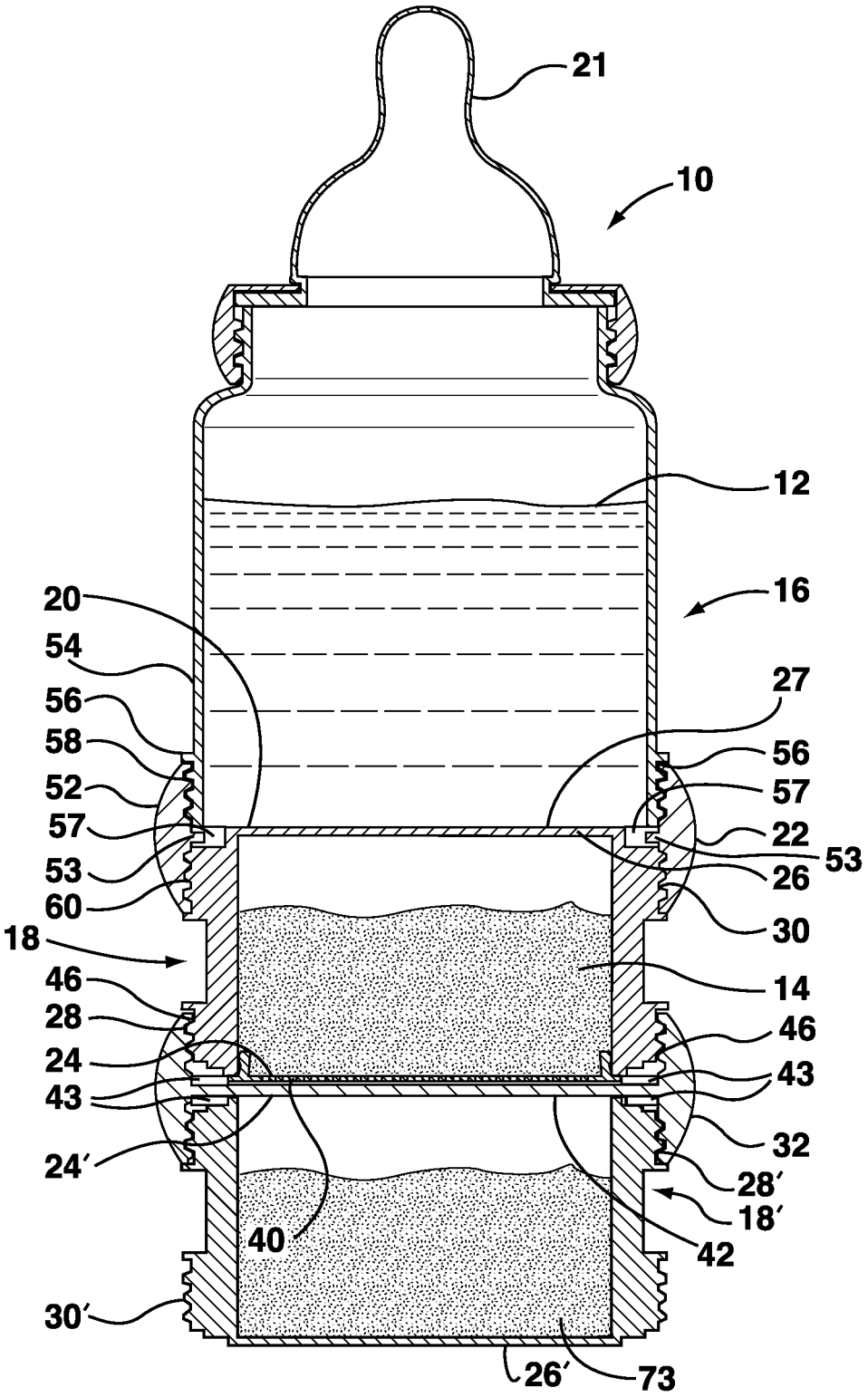
FIG. 16 is a cut-away sectional side view of the beverage container of FIG. 1 connected to an ancillary compartment.

In some embodiments, as exemplified in FIG. 16, beverage container 10 may further comprise another compartment, referred to herein as ancillary compartment 18', in addition to compartment 18. It will be appreciated that for simplicity and clarity of illustration, elements of ancillary compartment 18' corresponding or analogous to elements of compartment 18 are labeled with the same reference numerals as for compartment 18, [plus a prime (') notation]. For brevity, the description of some corresponding or analogous elements is not repeated.

In some embodiments, as shown in FIG. 16, compartment 18' has the same shape and size as compartment 18. In some embodiments, ancillary compartment 18' is identical to compartment 18. Ancillary compartment 18' may store an ancillary additive 73 therein. Ancillary additive 73 may be a different additive than additive 14 in compartment 18. In some embodiments, open end 24' of ancillary compartment 18' is connectable to closure 32 when closure 32 seals open end 24 of compartment 18. Connector 28' at open end 24' of ancillary compartment 18' may be removably connectable to closure 32. In this manner, closure 32 may fluidly seal open end 24 of compartment 18 from open end 24' of ancillary compartment 18'. In this manner, additive 12 and additive 73 may be separately stored from one another until mixing.

Upon mixing, open end 24 of compartment 18 and open end 24' of ancillary compartment 18' may be connected to base coupler 22 of vessel 16 at different times, to mix additive 12 and ancillary additive 73, respectively, with liquid 12 in vessel 16. Alternatively, ancillary additive 73 may be transferred into open end 24 of compartment 18, then compartment 18 may be connected to base coupler 22 to transfer additive 73 and additive 14 therein into vessel 16.

Figure 17:
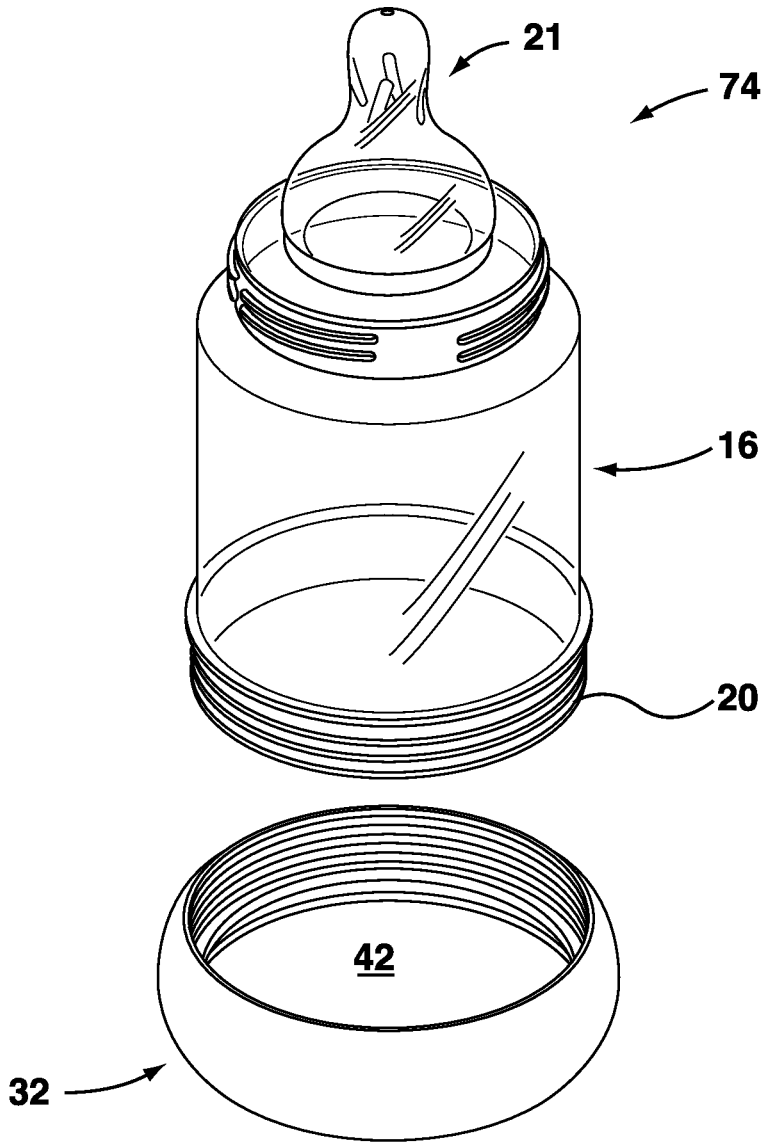
FIG. 17 is a perspective view of an exemplary single vessel container, wherein the vessel and closure of the single vessel container are unassembled.

Referring now to FIG. 17, closure 32 may be removably connectable to open base 20 of vessel 16 to removably seal open base 20 of the vessel. It is advantageous that the closure 32 is optionally connectable to three connectors (open base 20, open end 24 and closed end 26) on the beverage container. Attaching closure 32 to a connector may provide an additional layer of impact protection, in case the user drops the beverage container, for example.

Figure 18:
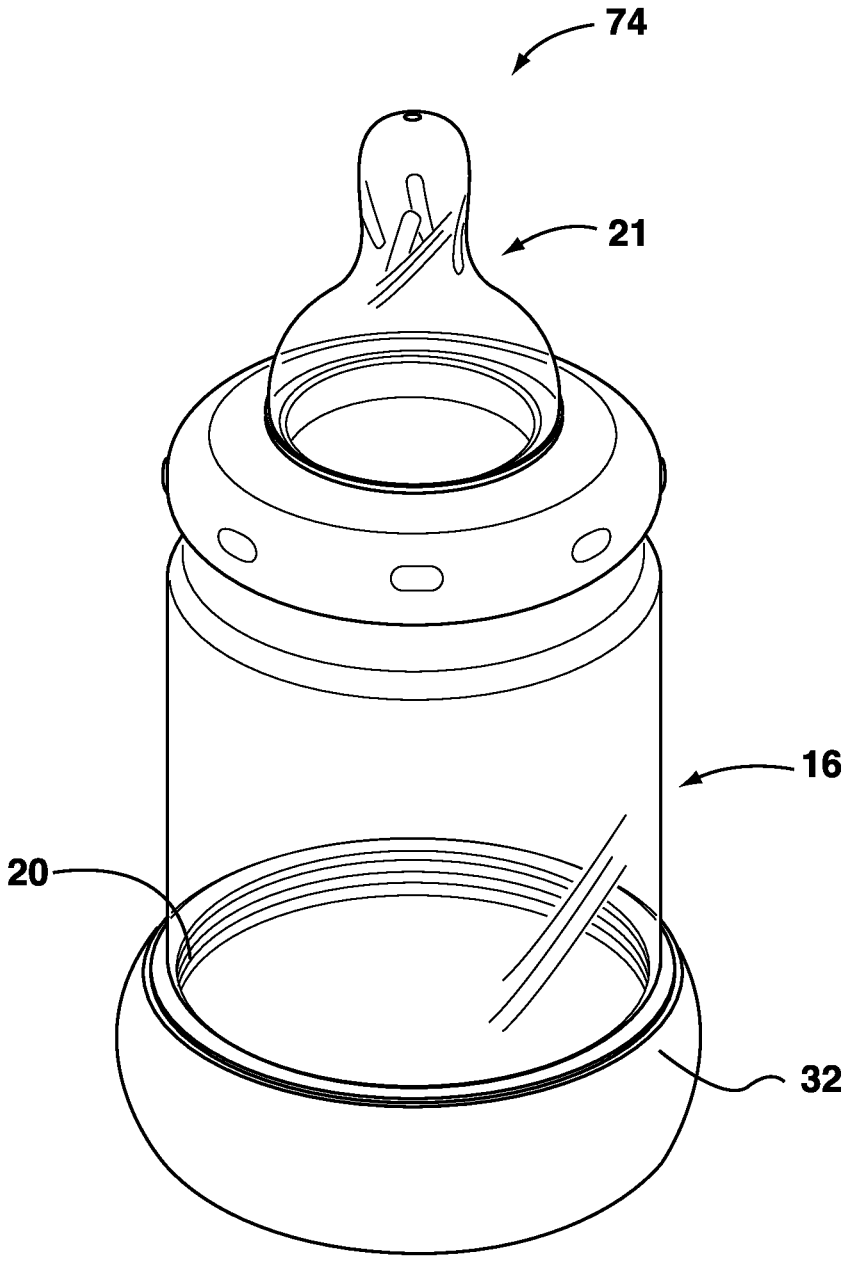
FIG. 18 is a perspective view of the assembled single vessel container of FIG. 17.

FIG. 18 shows closure 32 engaged with open base 20 of vessel 16, to fluidly seal open base 20. In this manner, beverage container 10, as shown in FIG. 2, for example, can be readily converted into a single vessel container 74, such as a baby bottle, for example. The single vessel container 74 may comprise release valve 21, vessel 16 and closure 32. This converted container may be used to hold a single liquid (which may or may not have been mixed with an additive). Due to its relatively fewer component parts, the single vessel container 74 exemplified in FIG. 18 may be more compact and easily transported than beverage container 10 (as exemplified in FIG. 1). The relatively more compact single vessel container 74 may be used when liquid or additive mixing is not required (or has already occurred). In this manner, a user may not need to buy separate containers for different situations. In other words, the same beverage container 10 that separates a liquid and an additive until mixing may be conveniently converted into a single vessel container 74.

To more fully describe an example conversion between container 10 (exemplified in FIG. 1) and single vessel container 74 (exemplified in FIG. 18), reference is had to FIG. 2.

As exemplified in FIG. 2, base coupler 22 may be removably engageable with open base 20 of vessel 16 and compartment 18 to removably couple compartment 18 to vessel 16. In some cases, base coupler 22 comprises a coupling ring 52 that is removably engageably with open base 20 of vessel 16, to removably couple compartment 18 to vessel 16.

In some cases, closure 32 comprises a closure ring 44 that is removably engageable with open base 20 of vessel 16 to removably seal open base 20 of vessel 16 when coupling ring 52 is disengaged from open base 20 of the vessel (as shown in FIG. 18).

Figure 19:
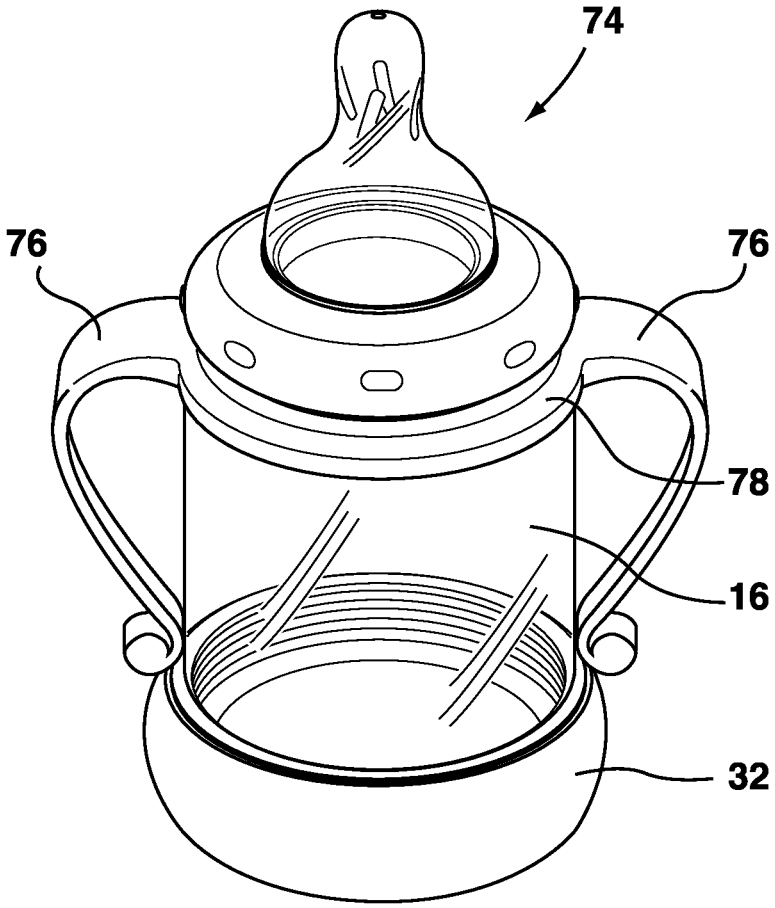
FIG. 19 is a perspective view of the assembled single vessel container of FIG. 18 connected to a handle.

Referring now to FIG. 19, single vessel 74 may have a handle 76. As exemplified in FIG. 19, single vessel 74 may have two handles 76 on opposing sides of vessel 16. Handles 76 may be removably attached to vessel 16 by a retaining ring 78. Handles 16 may allow a user to grab single vessel 74 and tilt the vessel to facilitate the consumption of a mixed beverage or liquid stored therein. Beverage container 10 (as shown in FIG. 1, for example), may also comprise at least one handle similar to handle 76. Two handles 76 may be removably connectable to opposing sides of vessel 16 of beverage container 10 shown in FIG. 1, in a similar manner to that shown in FIG. 19.

In some embodiments, indicia such as, for example, numbers, letters and animal pictures may be printed onto vessel 16. Such indicia may appeal to babies or infants that consume a beverage from vessel 16.

Another embodiment of this disclosure provides a kit assembly 10' for a beverage container for separately storing a liquid apart from an additive until mixing. In some embodiments, the kit assembly comprises at least some component parts similar to those discussed above with reference to unassembled beverage container 10, exemplified in FIG. 2. It will be appreciated that for simplicity and clarity of illustration, elements of kit assembly 10" corresponding or analogous to elements of beverage container 10 are labeled with the same reference numerals as for beverage container 10 [plus a double-prime (") notation]. For brevity, the description of some corresponding or analogous elements is not repeated.

Figure 20:
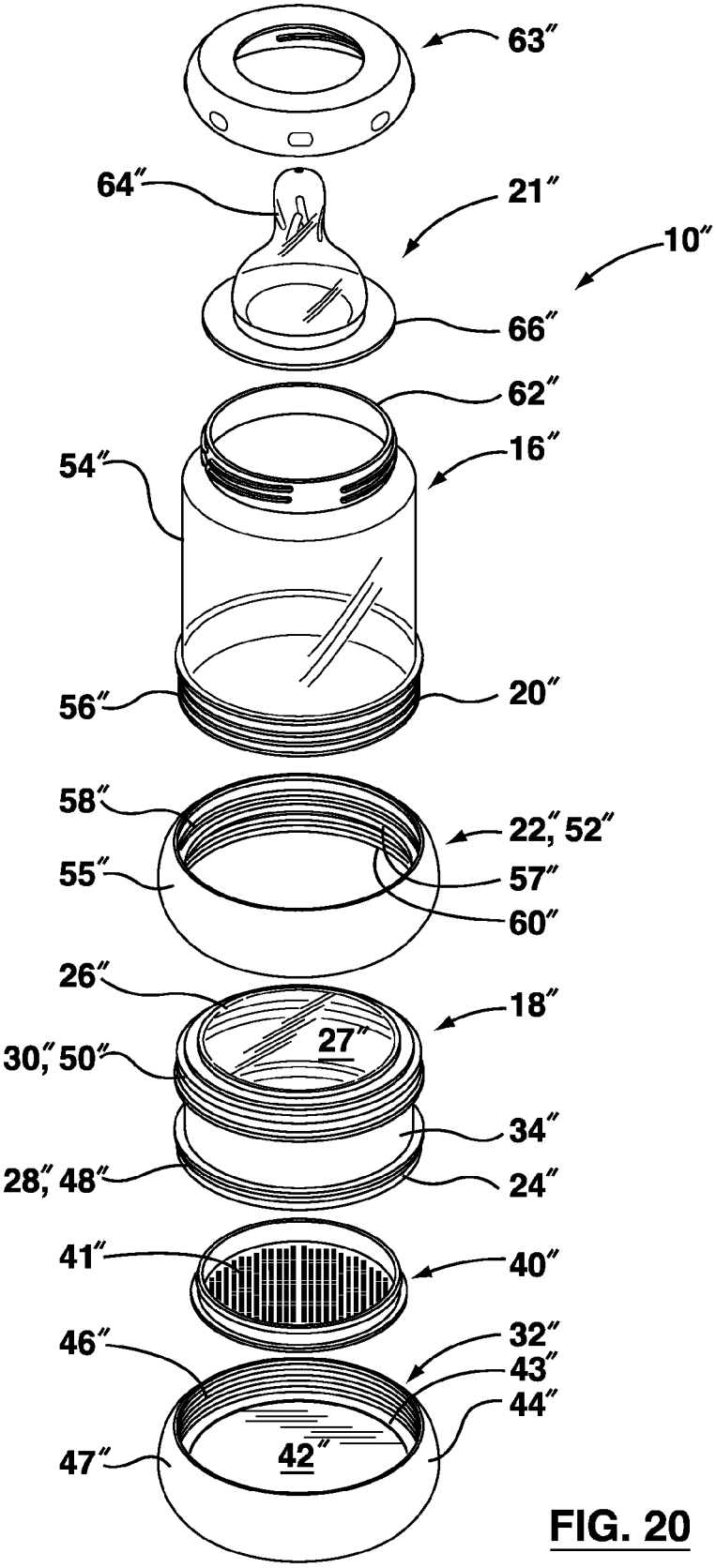
FIG. 20 is an exploded perspective view of a kit assembly for a beverage container in accordance with another embodiment of the invention.
Figure 21:
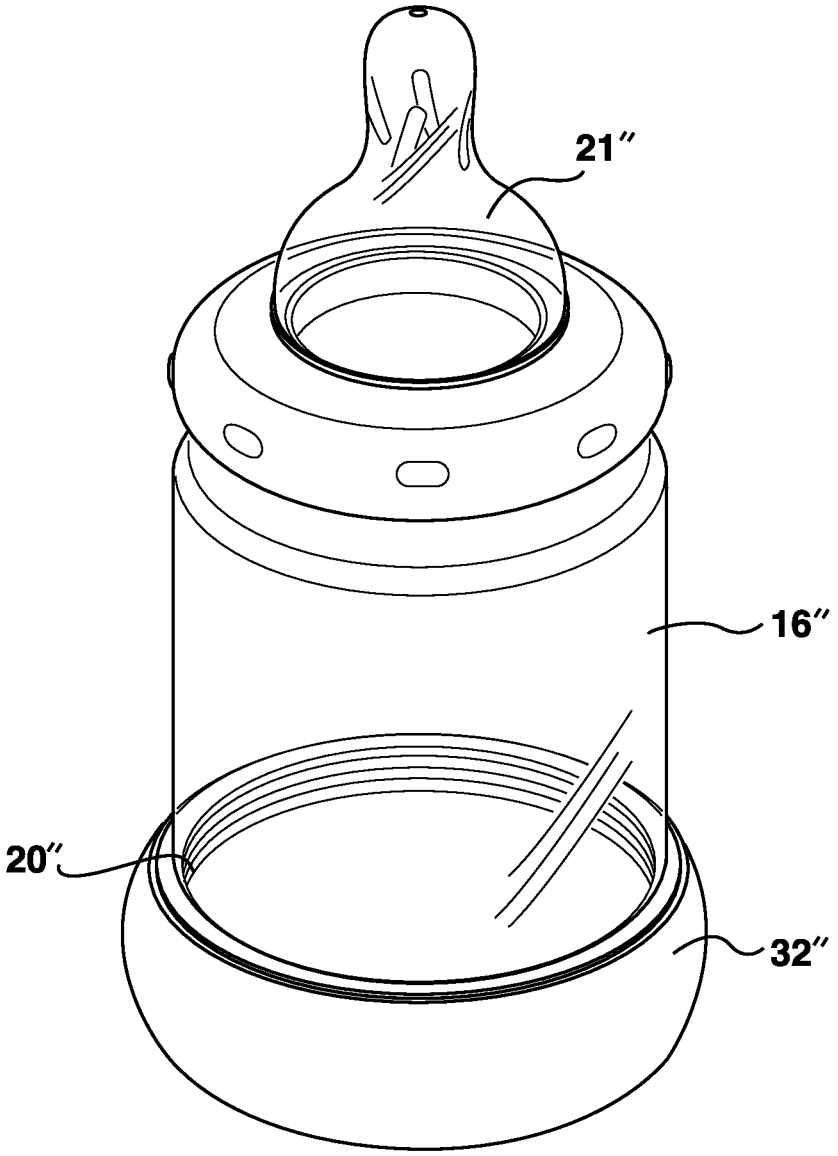
FIG. 21 is a perspective view of an exemplary kit assembly for a single vessel container.

Referring now to FIG. 20, an exemplary kit assembly 10" for a beverage container for separately storing a liquid apart from an additive until mixing. The exemplary kit assembly 10" shown in FIG. 20 has mouth 62" at one end of vessel 16" and an open base 20" at another end of vessel 16". The exemplary kit assembly 10" has a release valve 21" removably engageable with mouth 62" of vessel 16". The exemplary kit assembly also has a closure 32" removably connectable to open base 20" of vessel 16" to seal open base 20". FIG. 21 shows closure 32" connected to open base 20" of vessel 16.

Referring to FIG. 20, the kit assembly 10" optionally comprises a base coupler 22" removably connectable to open base 20" of vessel 16". The kit assembly optionally comprises compartment 18" for retaining an additive. Compartment 18", which is optionally part of kit assembly 10", has an open end 24" and an opposing closed end 26" and has compartment connectors (28" and 30") at each end of the compartment. If present, each of compartment connectors 28" and 30" are sealingly connectable to base coupler 22".

Continuing to refer to FIG. 20, connecting compartment connector 30" at closed end 26" of compartment 18" to base connector 22" separates the liquid and the additive. Connecting connector 28" at open end 24" of compartment 18" permits the liquid and additive to mix in vessel 16". If compartment 18" is present in kit assembly 10", closure 32" is connectable to open end 24" of compartment 18" to seal open end 24" when the liquid and additive are separated.

In some embodiments of kit assembly 10", vessel 16" is tubular and has a tubular wall 54". Closure 32" may comprise a closure ring 44" removably connectable with vessel 16" to surround a portion of tubular vessel 16".

Another embodiment of this disclosure provides a method for separately storing a liquid apart from an additive until mixing. An exemplary method will now be discussed in detail with reference to the exemplary embodiment of beverage container 10 shown in FIG. 2.

Figure 22:
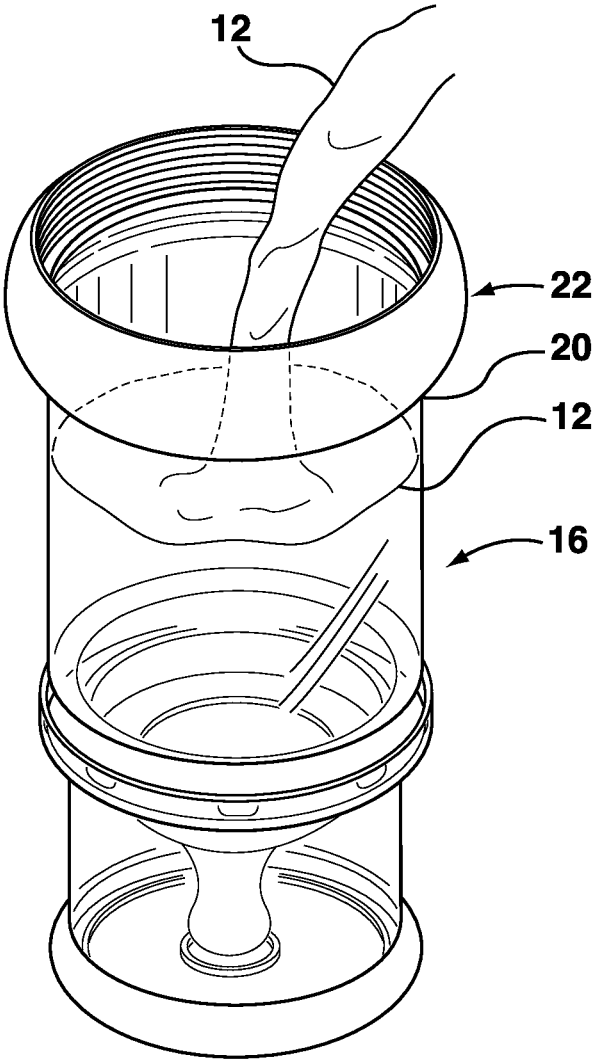
FIG. 22 is a perspective view of the beverage container of FIG. 1 with the compartment removed therefrom, showing the vessel being filled with liquid.

In an exemplary method, the user introduces liquid 12 into open base 20 of vessel 16 to fill the vessel with liquid 12. This step is shown in FIG. 22. As exemplified in FIG. 22, base coupler 22 is attached to open base 20 of vessel 16.

As exemplified in FIG. 22, the user may vertically orient vessel 16 in an inverted position wherein open base 20 of vessel 16 faces upwardly. This may be done prior to introducing liquid 12 into open base 20 of vessel 16. Alternatively, the user may tilt vessel 16 at an angle between horizontal and vertical when introducing liquid 12 into open base 20.

Figure 23:
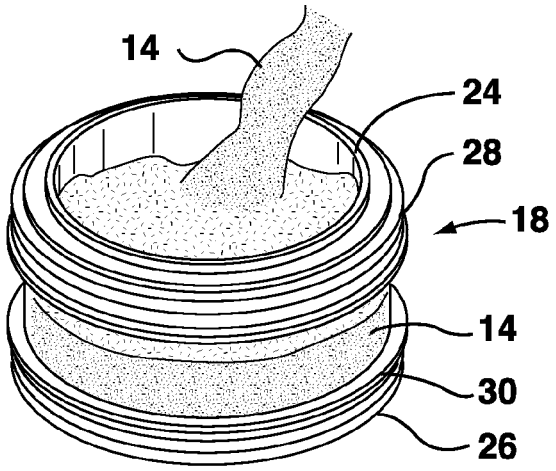
FIG. 23 is a perspective view of the compartment of FIG. 7 being filled with additive.

As exemplified in FIG. 23, the user places additive 14 in open end 24 of compartment 18, the compartment having an open end 24 and a closed end 26 opposing open end 24. As exemplified, compartment 18 has connectors 28 and 30 at open end 24 and closed end 26, respectively. Each of connectors 28 and 30 are sealingly engageable to base coupler 22 (shown in FIG. 22).

Figure 24:
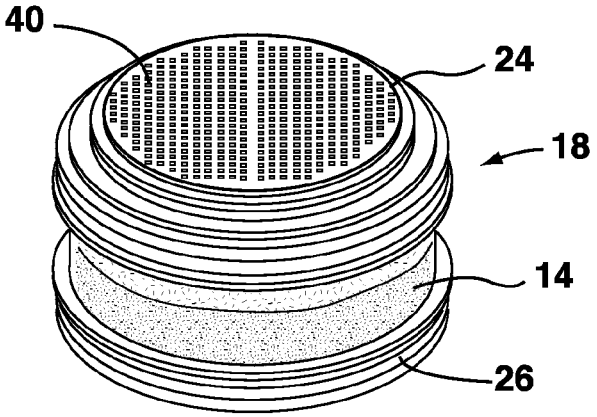
FIG. 24 is a perspective view of the compartment and sieve combination of FIG. 11, wherein the compartment contains additive.

As exemplified in FIG. 24, sieve 40 may be used. The user may cover open end 24 of compartment 18 with sieve 40. This may be done after placing the additive in open end 24 of compartment 18 (see FIG. 23).

Figure 25:
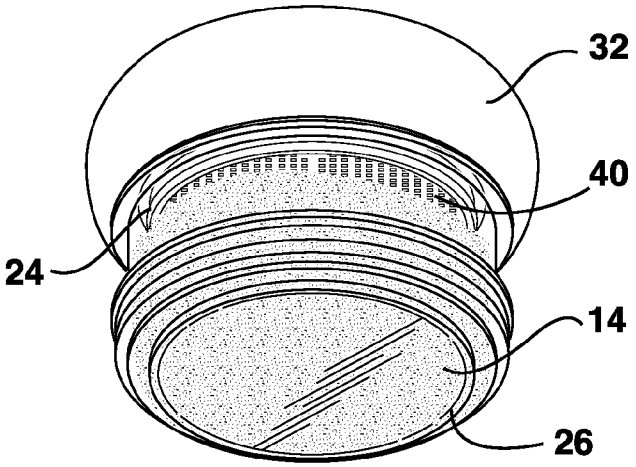
FIG. 25 is a perspective view of the compartment, sieve and closure combination of FIG. 12, wherein the compartment contains additive.

As exemplified in FIG. 25, the user seals open end 24 of compartment 18 with closure 32 to retain additive 14 therein.

Figure 26:
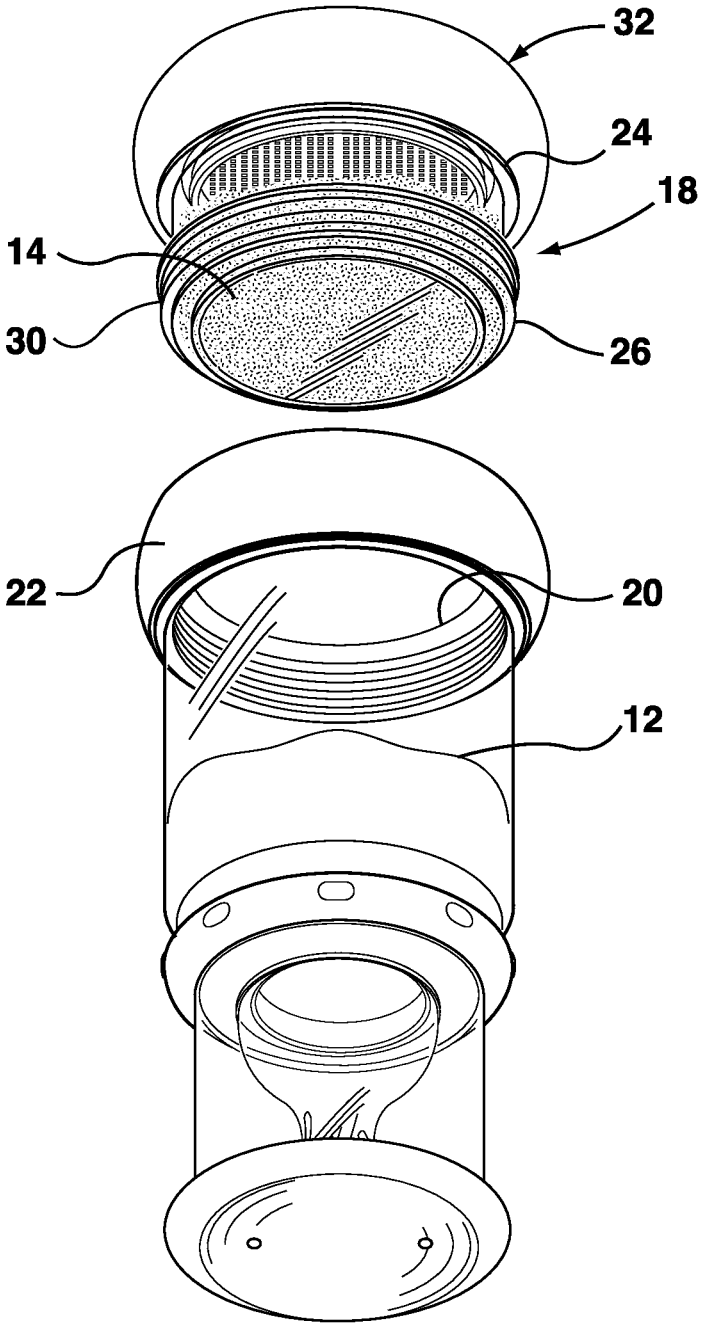
FIG. 26 is a perspective view of the unassembled beverage container of FIG. 1, in an inverted position and connected to a cap, wherein the compartment is in the closed position.

Referring now to FIG. 26, the user engages connector 30 at closed end 26 of compartment 18 to base coupler 22 to maintain liquid 12 and additive 14 separate from one another.

Figure 27:
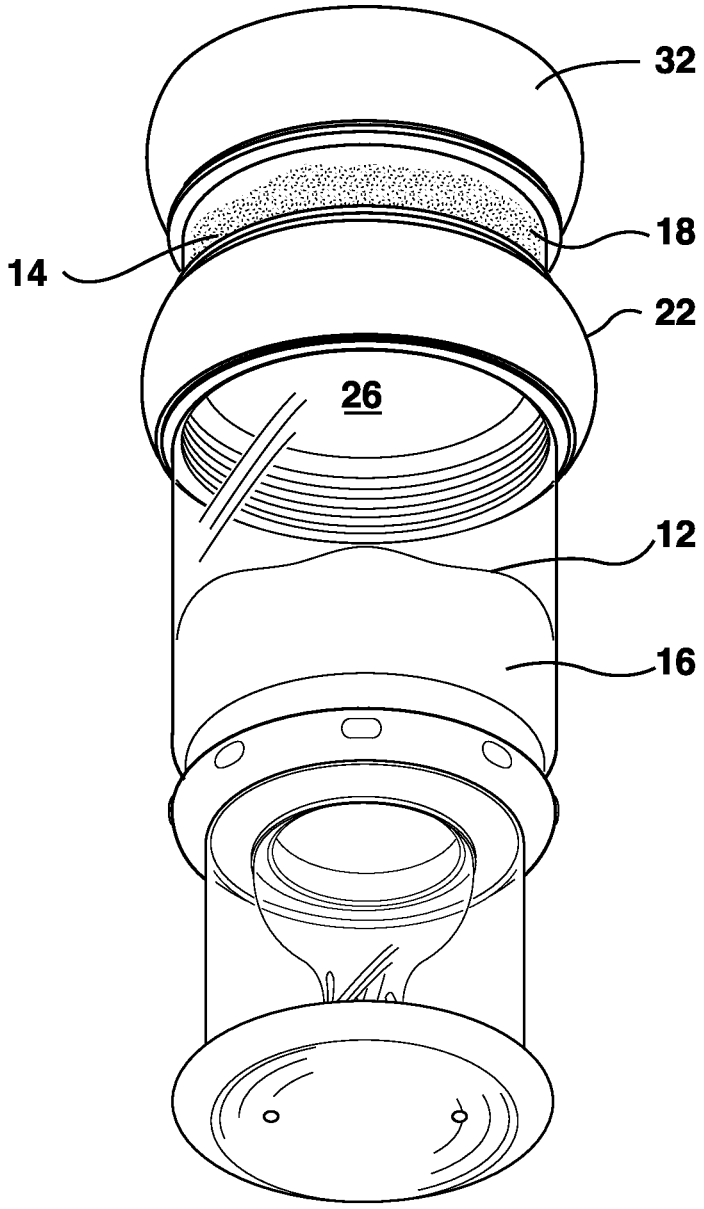
FIG. 27 is a perspective view of the assembled beverage container of FIG. 26.

FIG. 27 shows connector 30 (see connector 30 in FIG. 26) of compartment 18 connected to base coupler 22, to maintain liquid 12 in vessel 16 and additive 14 in compartment 18 separate from one another.

The user may seal open end 24 of compartment 18 with closure 32 (as shown in FIG. 25) before or after the connector at closed end 26 is connected to base coupler 22 (as shown in FIG. 27).

Figure 28:
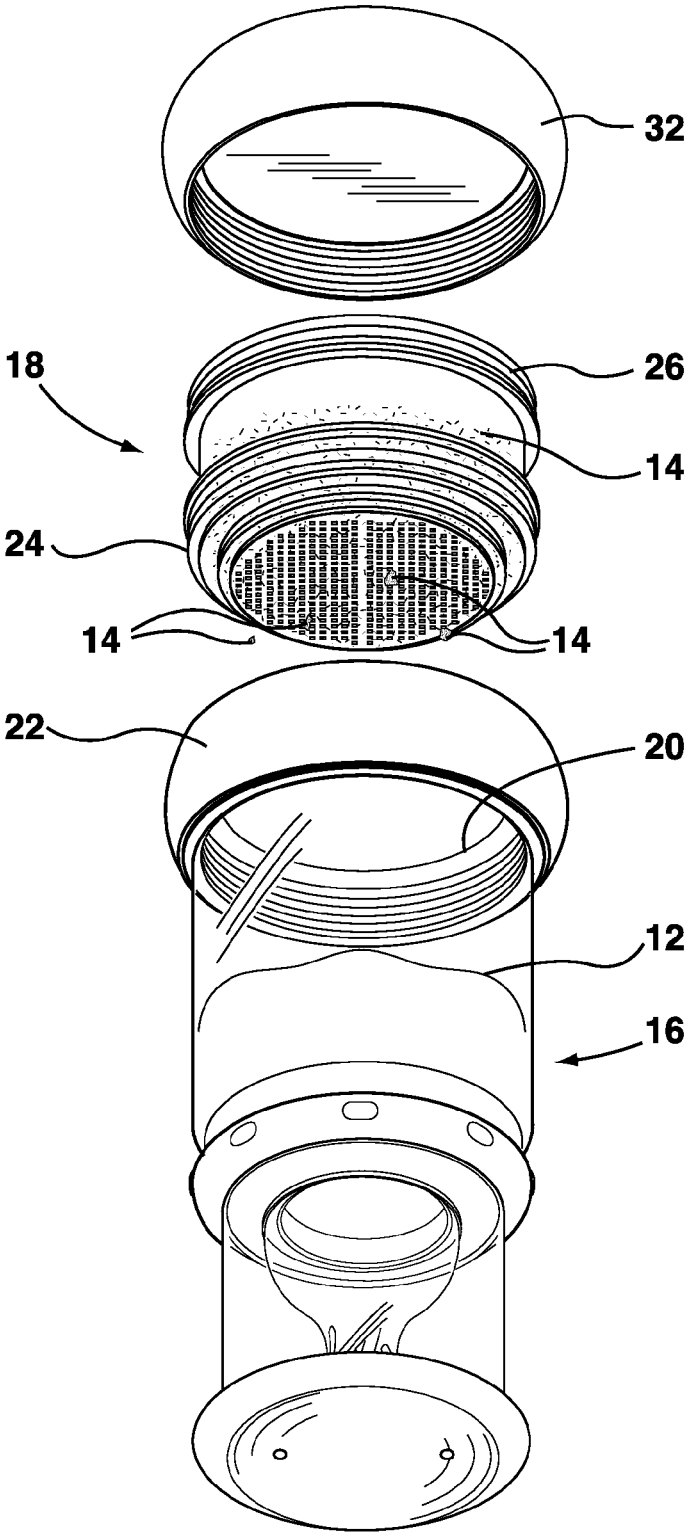
FIG. 28 is a perspective unassembled view of the beverage container of FIG. 1, in an inverted position and connected to a cap, wherein the compartment is in the open position.

As exemplified in FIG. 28, the user disengages closed end 26 of compartment 18 from base coupler 22. The user also moves closure 32 to unseal open end 24 of compartment 18.

Figure 29:
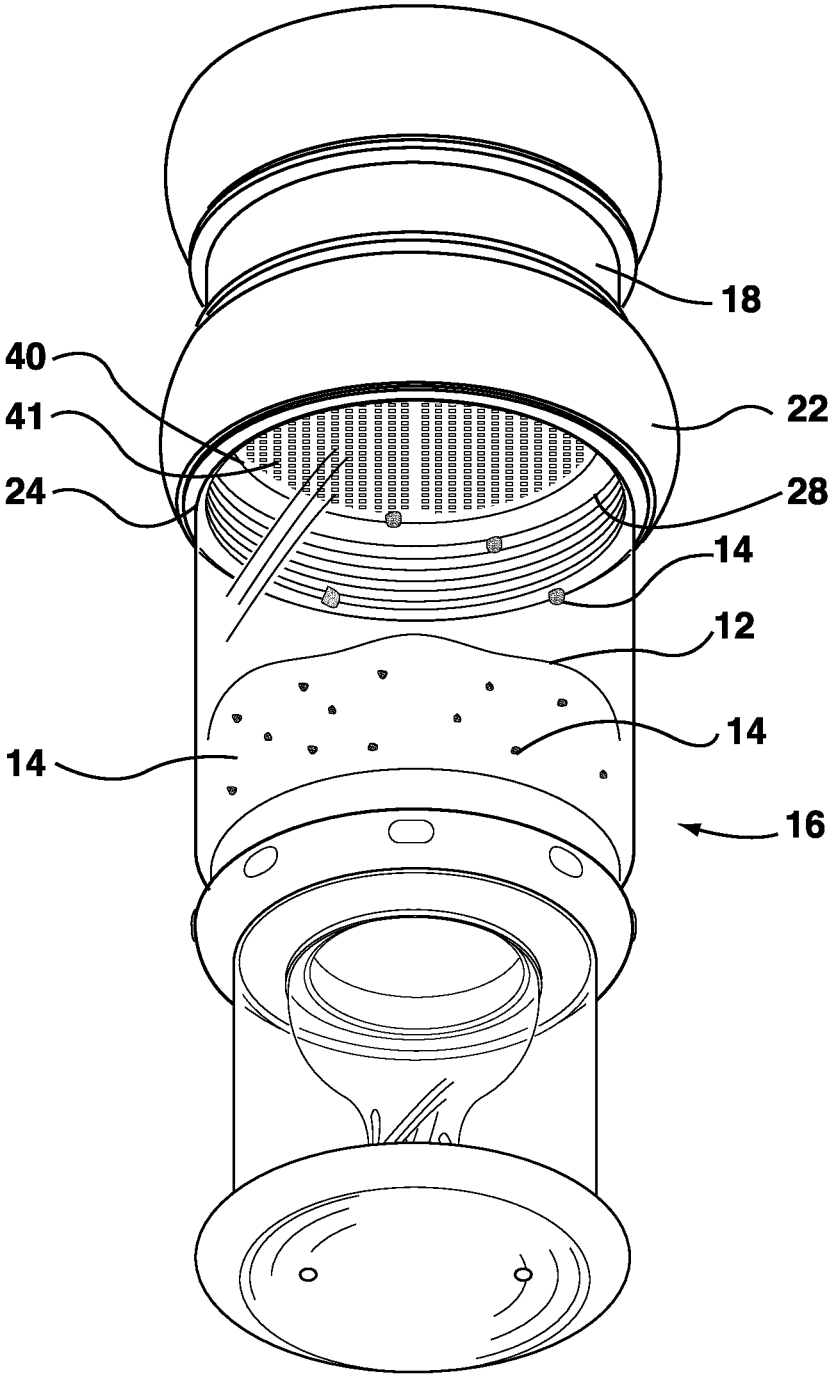
FIG. 29 is a perspective assembled view of the beverage container of FIG. 28.

Referring now to FIG. 29, the user engages connector 28 at open end 24 of compartment 18 to base coupler 22 to permit liquid 12 and additive 14 to mix in vessel 16.

When a sieve 40 is present, the step of engaging connector 28 at open end 24 of compartment 18 to base coupler 22 (as exemplified in FIG. 29) sifts additive 14 passing through sieve 40 that travels from compartment 18 to vessel 16. In this manner, sieve 40 can break-up additive 14 into relatively small pieces. When additive 14 is dry baby formula powder for example, additive 14 may pass through perforations 41 of the sieve, to break-up the dry powder into relatively small pieces. This may increase the degree with which additive 14 diffuses into liquid 12. Sieve 40 may reduce the amount of "clumps" of additive 14 that are ingested by the user consuming the mixed beverage. In the case of a mixed baby formula, this reduces the amount of powder "clumps" that may potentially clog a release valve, provide unpleasant mouth feel or be "spit-up" by a baby consuming the mixed formula.

To facilitate the mixing of additive 14 and liquid 12, the user may, for example, invert, shake, rotate, translate and/or agitate vessel 16.

Figure 30:
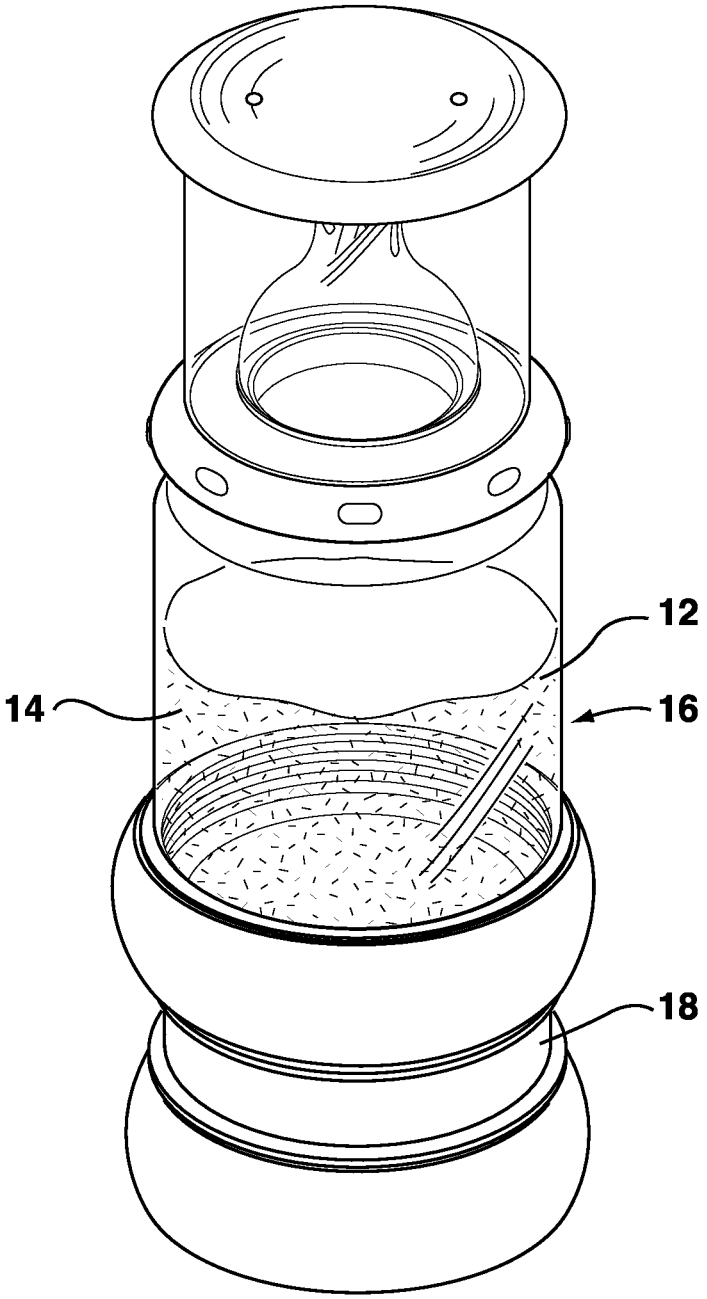
FIG. 30 is a perspective view of the beverage of container of FIG. 28, inverted from its position in FIG. 29.

FIG. 30 exemplifies vessel 16 rotated approximately 180 degrees relative to the position of vessel 16 shown in FIG. 29, to facilitate mixing of liquid 12 and additive 14.

Since several components of beverage container 10 are readily disengaged from one another (as shown in FIG. 2), the components may be separated and cleaned after mixing and consumption. By disassembling the component parts, it may be easier to remove clumps of additive 14 that may be deposited in the corners of various compartments. In embodiments of beverage container 10 having sieve 40, the sieve may beak-down additive 14 before it enters vessel 16 during mixing, thereby breaking-down the clumps of additive and simplifying the cleaning process after beverage consumption.

While the present embodiments as herein shown and described in detail are representative of the subject matter which is broadly contemplated by the present invention, the scope of the claims should not be limited by the preferred embodiments set forth in the examples, but should be given the broadest interpretation consistent with the description as a whole. Moreover, it is not necessary for an apparatus, kit assembly or method to address each and every problem sought to be solved by the present invention, for it is to be encompassed by the present claims.

The invention claimed is:

1. A beverage container for separately storing a liquid apart from an additive until mixing, comprising a vessel for retaining the liquid, the vessel having an open base at an end of the vessel;

a release valve connected to another end of the vessel;

a base coupler connected to the open base of the vessel;

a compartment for retaining the additive, the compartment having an open end and an opposing closed end and having a connector at each end of the compartment, each of the connectors sealingly connectable to the base coupler, wherein connecting the connector at the closed end of the compartment to the base coupler separates the liquid and the additive, and connecting the connector at the open end of the compartment to the base coupler permits the liquid and the additive to mix in the vessel; and a closure for sealing the open end of the compartment when the liquid and the additive are separated.

2. The beverage container of claim 1, wherein the compartment has a tubular wall extending between the open end and the closed end of the compartment.

3. The beverage container of claim 2, wherein a plane defined by the open end of the compartment is substantially parallel to a plane defined by the closed end of the compartment.

4. The beverage container of claim 1, further comprising a sieve removably connectable to the open end of the compartment.

5. The beverage container of claim 1, wherein the base coupler is removably attached to the open base of the vessel.

6. The beverage container of claim 5, wherein the vessel and the compartment are tubular, and the base coupler comprises a coupling ring surrounding a portion of the vessel and the compartment to couple the compartment to the vessel.

7. The beverage container of claim 6, further comprising exterior threading at the open base of the vessel matable with a first interior threading portion on the coupling ring, and wherein the connectors at the open end and the closed end of the compartment comprise exterior threading matable with a second interior threading portion on the coupling ring.

8. The beverage container of claim 1, wherein the closure is removably connectable to the connector at the open end of the compartment to removably seal the open end of the compartment.

9. The beverage container of claim 8, wherein the closure comprises a closure ring having internal threading, the connector at the open end of the compartment comprises external threading engageable with internal threading on the closure ring, to couple the closure ring to the open end of the compartment.

10. The beverage container of claim 1, wherein the closure is removably connectable to the connector at the closed end of the compartment.

11. The beverage container of claim 1, wherein the closure is removably connectable to the open base of the vessel to removably seal the open base of the vessel.

12. The beverage container of claim 1, wherein the base coupler comprises a coupling ring that is removably engageable with the open base of the vessel and the compartment to removably couple the compartment to the vessel, and the closure comprises a closure ring that is removably engageable with the open base of the vessel to removably seal the open base of the vessel when the coupling ring is disengaged from the open base of the vessel.

13. The beverage container of claim 1, wherein the release valve is removably attached with a mouth of the vessel, when the release valve is engaged with the mouth, the release valve fluidly closes the mouth of the vessel, and when the release valve is disengaged from the mouth, the mouth is open to receive the liquid therethrough.

14. The beverage container of claim 1, further comprising a valve ring removably connectable with the vessel to removably attach the release valve to the vessel.

15. The beverage container of claim 1, further comprising a cap removably engageable with the vessel to cover the release valve, wherein the cap has a first end that engages the vessel and a second end opposing the first end, the second end having a substantially planar surface.

16. The beverage container of claim 1, further comprising another compartment for retaining an ancillary additive, the other compartment having an open end and an opposing closed end and having a connector at the open end of the other compartment, the connector at the open end of the other compartment sealingly connectable with the closure; wherein when the closure seals the open end of the compartment, connecting the connector at the open end of the other compartment to the closure separates the additive in the compartment from the ancillary additive in the other compartment.

17. A kit assembly for a beverage container for separately storing a liquid apart from an additive until mixing, the kit assembly comprising:

a vessel for retaining the liquid, the vessel having a mouth at one end and an open base at the other end;

a release valve removably engageable with the mouth of the vessel;

a closure removably connectable to the open base of the vessel to seal the open base; and the kit assembly comprising:

a base coupler removably connectable to the open base of the vessel; and a compartment for retaining the additive, the compartment having an open end and an opposing closed end and having a connector at each end of the compartment, each of the connectors sealingly connectable to the base coupler, wherein connecting the connector at the closed end of the compartment to the base connector separates the liquid and the additive, connecting the connector at the open end of the compartment to the base connector permits the liquid and additive to mix in the vessel, and the closure is connectable to the open end of the compartment to seal the open end of the compartment when the liquid and the additive are separated.

18. A method for separately storing a liquid apart from an additive until mixing, the method comprising:

introducing the liquid into an open base of a vessel to fill the vessel with the liquid, wherein a base coupler is attached to the open base of the vessel;

placing an additive in an open end of a compartment having a closed end opposing the open end, the compartment having connectors at each end of the compartment, each of the connectors sealingly engageable to the base coupler;

sealing the open end of the compartment with a closure to retain the additive therein;

engaging the connector at the closed end of the compartment to the base coupler to maintain the liquid and the additive separate from one another;

disengaging the closed end of the compartment from the base coupler;

moving the closure to unseal the open end of the compartment;

engaging the connector at the open end of the compartment to the base coupler to permit the liquid and additive to mix in the vessel.

19. The method of claim 18, further comprising vertically orienting the vessel in an inverted position wherein the open base of the vessel faces upwardly prior to introducing the liquid into the open base of the vessel.

20. The method of claim 18, further comprising covering the open end of the compartment with a sieve after placing the additive in the open end of the compartment, and wherein engaging the connector at the open end of the compartment to the base coupler sifts the additive passing through the sieve that travels from the compartment to the vessel.

* * * * *